US009945538B2

(12) United States Patent
Beausoleil

(10) Patent No.: US 9,945,538 B2
(45) Date of Patent: Apr. 17, 2018

(54) LANDSCAPE LIGHTING SYSTEMS HAVING INTERCHANGEABLE LIGHT DIVERTING ELEMENTS AND LIGHT INTENSITY CONTROLLERS

(71) Applicant: Mind Head LLC, Ridgewood, NJ (US)

(72) Inventor: David M. Beausoleil, Ridgewood, NJ (US)

(73) Assignee: Mind Head LLC, Ridgewood, NJ (US)

( * ) Notice: Subject to any disclaimer, the term of this patent is extended or adjusted under 35 U.S.C. 154(b) by 0 days.

(21) Appl. No.: 15/370,294

(22) Filed: Dec. 6, 2016

(65) Prior Publication Data

US 2017/0082271 A1 Mar. 23, 2017

Related U.S. Application Data

(63) Continuation of application No. 15/130,999, filed on Apr. 17, 2016, now Pat. No. 9,541,263, which is a (Continued)

(51) Int. Cl.
*F21S 6/00* (2006.01)
*F21V 17/00* (2006.01)
(Continued)

(52) U.S. Cl.
CPC ..... *F21V 17/002* (2013.01); *F21K 9/60* (2016.08); *F21S 6/004* (2013.01); *F21S 8/032* (2013.01); *F21S 8/083* (2013.01); *F21V 1/08* (2013.01); *F21V 9/08* (2013.01); *F21V 11/16* (2013.01); *F21V 21/0824* (2013.01); *F21V 21/14* (2013.01); *F21V 21/30* (2013.01); *F21V 23/003* (2013.01); *F21V 23/006* (2013.01); *F21V 23/0435* (2013.01); *F21V 29/70* (2015.01); *H05B 33/0845* (2013.01); *H05B 37/0272* (2013.01); *F21W 2131/10* (2013.01);
(Continued)

(58) Field of Classification Search
CPC ..... F21V 17/002; F21V 21/14; F21V 11/16; F21S 6/004; F21S 8/083
See application file for complete search history.

(56) References Cited

U.S. PATENT DOCUMENTS 3,251,985 A 5/1966 Krupnick
3,428,798 A 2/1969 Hilzen
(Continued)

*Primary Examiner* — Anabel Ton
(74) *Attorney, Agent, or Firm* — Doherty IP Law Group LLC

(57) ABSTRACT

A landscape lighting system includes a light fixture having an LED, a first light diverting element having a first light diversion angle associated therewith, a second light diverting element having a second light diversion angle associated therewith that is different than the first light diversion angle, and a light intensity controller for communicating with the light fixture to selectively control the intensity of the light generated by the LED. The light intensity controller is in wireless communication with the light fixture. The fixture has a first configuration in which the first light diverting element overlies the LED for emitting light having the first light diversion angle, and a second configuration in which the second light diverting element overlies the LED for emitting light having the second light diversion angle.

19 Claims, 19 Drawing Sheets

Related U.S. Application Data continuation of application No. 14/836,722, filed on Aug. 26, 2015, now Pat. No. 9,316,379, which is a continuation of application No. 14/728,326, filed on Jun. 2, 2015, now Pat. No. 9,140,414, which is a continuation of application No. 13/969,183, filed on Aug. 16, 2013, now Pat. No. 9,115,857.

(60) Provisional application No. 61/718,852, filed on Oct. 26, 2012, provisional application No. 61/789,449, filed on Mar. 15, 2013.

(51) Int. Cl.

| | |
|---|---|
| ***F21S 8/08*** | (2006.01) |
| ***F21V 21/08*** | (2006.01) |
| ***F21V 29/70*** | (2015.01) |
| ***F21V 11/16*** | (2006.01) |
| ***F21V 21/30*** | (2006.01) |
| ***H05B 33/08*** | (2006.01) |
| ***H05B 37/02*** | (2006.01) |
| ***F21S 8/00*** | (2006.01) |
| ***F21V 1/08*** | (2006.01) |
| ***F21V 21/14*** | (2006.01) |
| ***F21V 23/00*** | (2015.01) |
| ***F21V 23/04*** | (2006.01) |
| ***F21K 9/60*** | (2016.01) |
| ***F21V 9/08*** | (2018.01) |
| *F21W 131/109* | (2006.01) |
| *F21W 131/10* | (2006.01) |
| *F21Y 101/00* | (2016.01) |
| *F21Y 115/10* | (2016.01) |

(52) U.S. Cl.
CPC .... *F21W 2131/109* (2013.01); *F21Y 2101/00* (2013.01); *F21Y 2115/10* (2016.08)

(56) References Cited

U.S. PATENT DOCUMENTS

| | | | | |
|---|---|---|---|---|
| 4,870,548 | A | 9/1989 | Beachy et al. | |
| 4,945,675 | A * | 8/1990 | Kendrick | A01G 1/08 239/201 |
| 4,984,143 | A | 1/1991 | Richardson | |
| 5,909,087 | A * | 6/1999 | Bryde | H05B 37/0263 315/149 |
| 6,106,134 | A * | 8/2000 | Bomas | F21S 8/083 362/153 |
| 6,250,771 | B1 | 6/2001 | Sharrah et al. | |
| 6,796,683 | B2 | 9/2004 | Wood et al. | |
| 6,933,680 | B2 | 8/2005 | Oskorep et al. | |
| 6,964,510 | B2 | 11/2005 | Galli | |
| 7,063,441 | B2 * | 6/2006 | Kramer | F21S 10/02 362/231 |
| 7,137,721 | B1 | 11/2006 | Rao et al. | |
| 7,204,606 | B2 | 4/2007 | Brass et al. | |
| 7,534,975 | B1 | 5/2009 | Sharrah et al. | |
| 7,618,150 | B2 | 11/2009 | Chien | |
| 7,901,096 | B2 | 3/2011 | Klepp | |
| 8,029,149 | B2 | 10/2011 | Klepp | |
| 8,066,403 | B2 | 11/2011 | Sanfilippo et al. | |
| 8,300,293 | B2 * | 10/2012 | Violonchi | F21S 10/00 359/196.1 |
| 9,115,857 | B2 * | 8/2015 | Beausoleil | F21S 6/004 |
| 9,140,414 | B1 * | 9/2015 | Beausoleil | F21S 6/004 |
| 9,316,379 | B2 * | 4/2016 | Beausoleil | F21V 17/002 |
| 9,541,263 | B2 | 1/2017 | Beausoleil | |
| 2002/0021573 | A1 | 2/2002 | Zhang | |
| 2002/0176250 | A1 | 11/2002 | Bohler et al. | |
| 2003/0016532 | A1 | 1/2003 | Reed | |
| 2004/0233676 | A1 | 11/2004 | Matts et al. | |
| 2005/0122714 | A1 | 6/2005 | Matthews et al. | |
| 2005/0252753 | A1 | 11/2005 | Leo | |
| 2006/0039160 | A1 | 2/2006 | Cassarly et al. | |
| 2006/0187656 | A1 | 8/2006 | Kuelbs et al. | |
| 2007/0070530 | A1 | 3/2007 | Seo et al. | |
| 2007/0229250 | A1 * | 10/2007 | Recker | G08B 5/36 340/531 |
| 2008/0310167 | A1 | 12/2008 | Zaderej et al. | |
| 2009/0185377 | A1 | 7/2009 | Johnson | |
| 2010/0259200 | A1 | 10/2010 | Beausoleil | |
| 2013/0343057 | A1 | 12/2013 | Quadri | |

* cited by examiner

FIG. 3
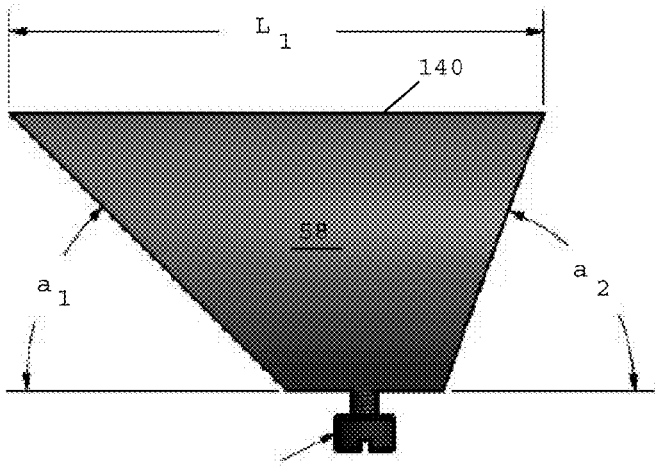
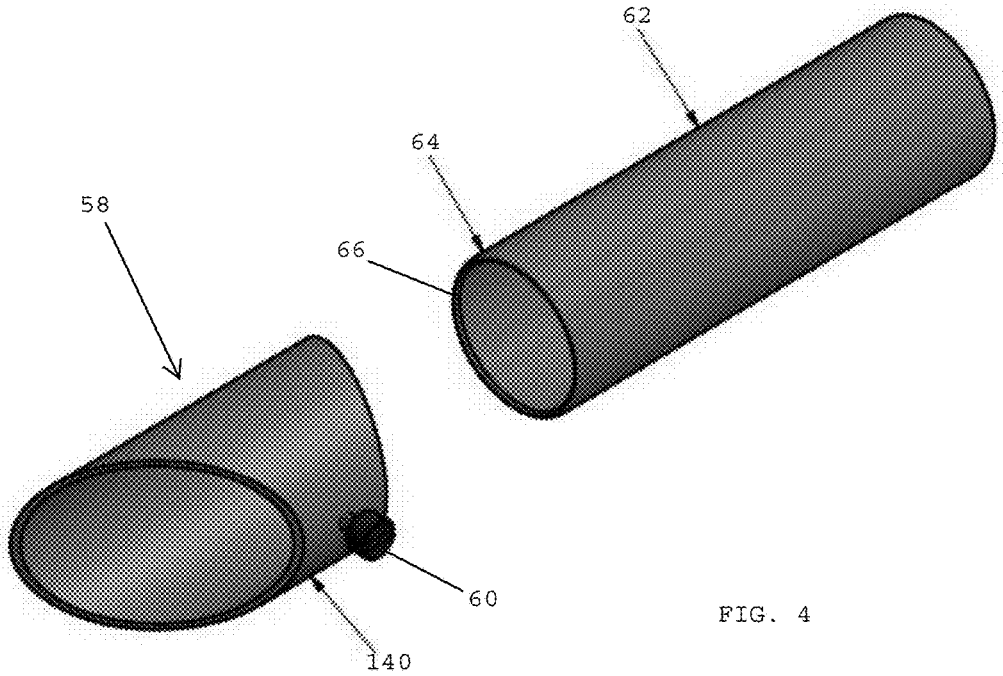
FIG. 4

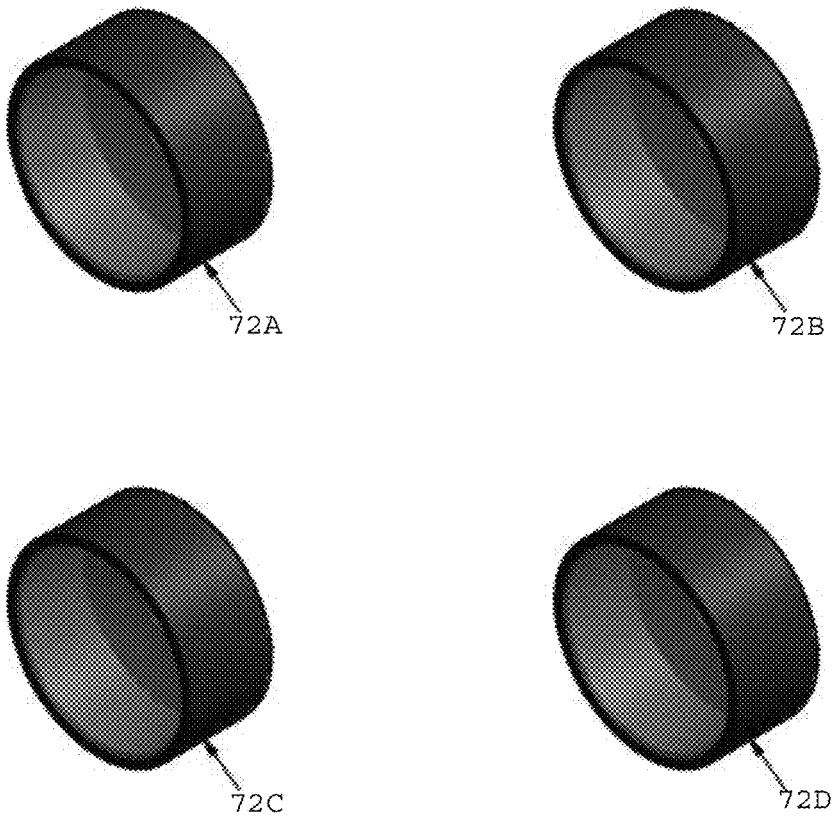
FIG. 5A
FIG. 5B
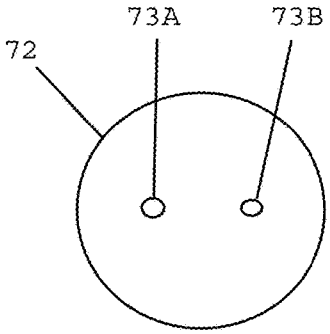

FIG. 6A
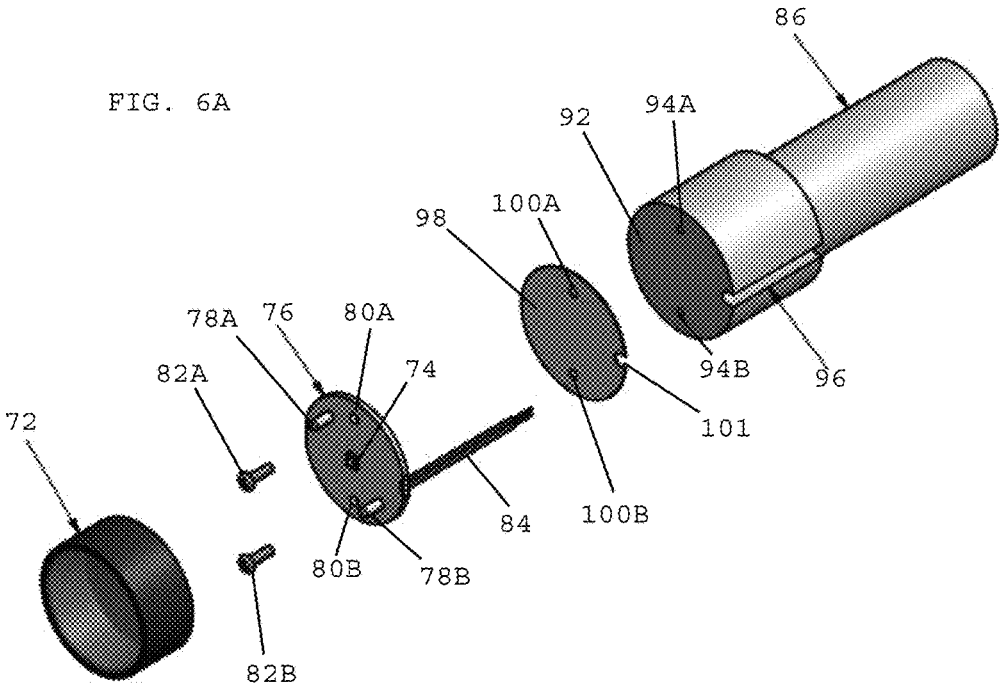
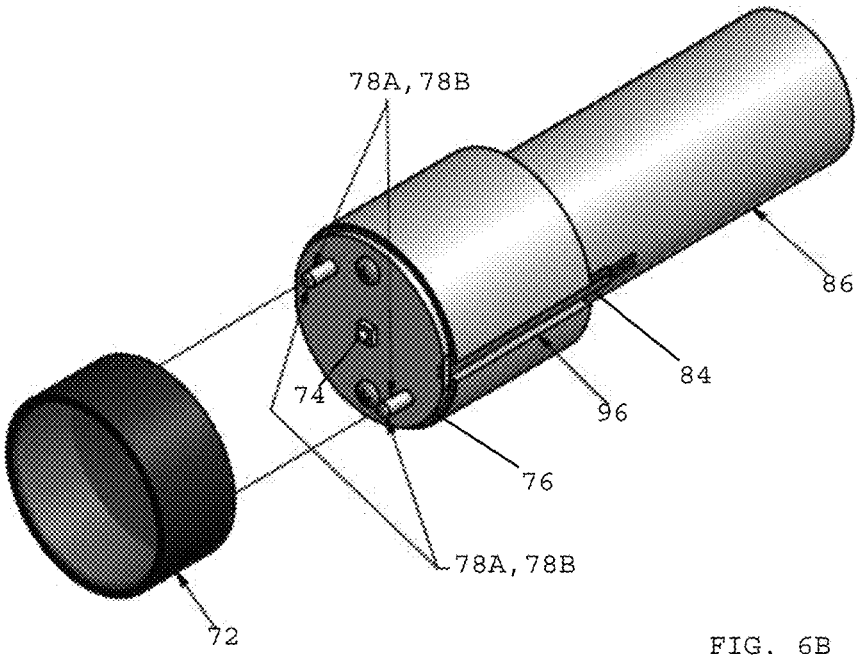
FIG. 6B

LANDSCAPE LIGHTING SYSTEMS HAVING INTERCHANGEABLE LIGHT DIVERTING ELEMENTS AND LIGHT INTENSITY CONTROLLERS

CROSS REFERENCE TO RELATED APPLICATIONS

The present patent application is a continuation of U.S. patent application Ser. No. 15/130,999, filed Apr. 17, 2016, now allowed, which is a continuation of U.S. patent application Ser. No. 14/836,722, filed Aug. 26, 2015, now U.S. Pat. No. 9,316,379, which is a continuation on U.S. patent application Ser. No. 14/728,326, filed Jun. 2, 2015, now U.S. Pat. No. 9,140,414, which is a continuation of U.S. patent application Ser. No. 13/969,183, filed Aug. 16, 2013, now U.S. Pat. No. 9,115,857, which claims benefit of U.S. Provisional Application No. 61/718,852, filed Oct. 26, 2012, and U.S. Provisional Application No. 61/789,449, filed Mar. 15, 2013, the disclosures of which are hereby incorporated by reference herein.

BACKGROUND OF THE INVENTION

Field of the Invention

The present application is generally related to lighting and is more specifically related to landscape lighting systems and light fixtures used to provide landscape lighting.

Description of the Related Art

Landscape lighting designers and installers typically utilize various lighting techniques to create a decorative landscape lighting design for a property owner. The selected landscape lighting design matches the property owner's preferences, desires, and tastes, and the theme that exists for the property. Property owner preferences may include safety, security and the beautification of the property's outdoor landscape.

Satisfying a property owner's landscape lighting objectives may be accomplished using different lighting design techniques. In many instances, the lighting fixture used to achieve these objectives is a directional flood light. Some of the more popular techniques used to create an overall lighting design include up lighting, moon lighting, cross lighting, mirror lighting, wash lighting, wall lighting, step lighting, grazing, silhouetting, backlighting, shadowing, path lighting, down lighting, and reflected lighting.

In many instances, landscape lighting designers seek to create a cohesive lighting design that is specific to the elements that exist on a specific property. The goal of the installer is to provide a cohesive well lit scene, and to incorporate other aesthetic lighting techniques such as cohesion, visual depth, focal points, shadows, textures, perspective, lighting balance, and symmetry, as well as different lighting "rooms" and an overall visually interactive space for the subject property.

Any professional landscape lighting designer knows that light output levels and beam selection is extremely important in order to create depth, dimension, texture, space, focal points and produce a really spectacular landscape lighting design. Merely washing all of the plant material, regardless of size, diaphanous or reflective properties, surface textures and the like, at the same brightness washes out and flattens the design so that no lighting design of any consequence will result. Bad lighting designs result in hot spots, black unlit holes, uneven illumination levels, overly bright spots and under-illuminated areas. The extreme differences between the contrasting light levels fatigue the eye and results in landscape lighting that is uncomfortable to look at.

Thus, there remains a need for improved landscape lighting systems and improved light fixtures that provide improved light intensity control and improved control over the direction of the light. In addition, there remains a need for lighting systems that enable the beam angle, beam spread and cone of light emanating from light fixtures to be changeable, controllable and adjustable to meet a wide range of landscape lighting needs. There also remains a need for landscape lighting systems whereby adjustments to the light intensity level may be made during the day.

SUMMARY OF THE INVENTION

In one embodiment, a landscape lighting system preferably includes a housing, such as a light engine slug, made of a thermally conductive metal, an LED secured to a leading end of the light engine slug, an LED driver for controlling operation of the LED, the LED driver being spaced from the LED, and conductive wires electrically interconnecting the LED driver with the LED. The LED driver may be disposed within the body of the lighting engine slug.

In one embodiment, the LED produces white light. In one embodiment, the LED is an XLamp XM-L2 LED sold by Cree, Inc. of Durham, N.C. In one embodiment, the LED is sold under model number XMLBWT-00-0000-000LT20E8 by Cree, Inc. of Durham, N.C.

In one embodiment, the landscape lighting system desirable has a plurality of interchangeable light diverting elements adapted to be secured over the LED, whereby each of the light diverting elements has a unique light diversion angle associated therewith. In one embodiment, the system has light diverting elements with different angles including 12 degrees, 24 degrees, 36 degrees, and 60 degrees. In one embodiment, a system may include a light diverting element that diverts light in a rectangular pattern such as a 15 degree×30" rectangular pattern. In one embodiment, a system may include one or light fixtures that are used as wash lights with no light diverting element/optic used. In one embodiment, only one of the light diverting elements is secured over the LED at any one time. The light diverting elements are interchangeable so that a design can control the diversion angle and/or beam angle for each light fixture.

In one embodiment, the landscape lighting system preferably includes a light intensity controller in communication with the LED driver. The light intensity controller desirably includes a control element, such as a button, knob, or switch, which enables an operator to selectively increase and decrease the intensity of the light generated by the LED. In one embodiment, the direction of the change in the light intensity reverses each time the control element is engaged so that an operator may make fine adjustments up and down until a desired light intensity level is attained.

In one embodiment, the control element on the light intensity controller includes a button, such as a depressible button. In one embodiment, the intensity of the light generated by the LED increases the first time the button is engaged and reverses direction and decreases when the button is released and then re-engaged. In one embodiment, the intensity of the light generated by the LED reverses once again and increases the third time the button is released and re-engaged. In one embodiment, the direction of change of the intensity of the light generated by the LED reverses each time the button is released and re-engaged (e.g., depressed). This feature enables an operator to fine tune the light intensity level using the naked eye and without having to cycle completely though the various light intensity levels when making adjustments. In one embodiment, after the light intensity level has been adjusted by engaging the button, the light intensity level remains constant when the button is disengaged or released.

In one embodiment, the light intensity controller preferably includes an illuminated scale that indicates the intensity level of the light generated by the LED. The illuminated scale preferably ranges from a low light intensity level to a high light intensity level. In one embodiment, the illuminated scale has a different indicator (e.g. a number) associated with each of the distinct light intensity levels on the scale. In one embodiment, the scale includes a series of illuminated elements that are illuminated to indicate the light intensity level. In one embodiment, the illuminated scale ranges from intensity level one (#1) at the lower end of the light intensity range to intensity level ten (#10) at the upper end of the light intensity range.

In one embodiment, the light engine slug is preferably made of a thermally conductive metal and has a flat surface at the leading end thereof. The system desirably includes an LED substrate overlying the flat surface of the light engine slug. The LED substrate may be flat and have an outer perimeter that matches the shape of the outer perimeter of the flat surface at the leading end of the light engine slug. In one embodiment, a thermally conductive pad may be disposed between the LED substrate and the flat surface of the light engine slug.

In one embodiment, the LED substrate preferably includes one or more guide pins that extend along a longitudinal axis of the light engine slug. Each of the light diverting elements preferably has one or more guide pin openings adapted to slide over the one or more guide pins on the LED substrate. The inner diameters of the guide pin openings desirably closely match the outer diameters of the guide pins for forming a friction fit between the guide pin openings and the guide pins.

In one embodiment, the LED driver is preferably disposed within the light engine slug. The LED driver may include a microprocessor and a memory for storing information about the light intensity level adjustment and the direction of change of the last light intensity level adjustment. In one embodiment, the light engine slug preferably has an elongated groove formed in an outer surface of the light engine slug that extends along the longitudinal axis of the light engine slug. The elongated groove desirably extends from the flat surface at the leading end of the light engine slug toward a trailing end of the light engine slug. In one embodiment, the conductive wires electrically interconnecting the LED and the LED driver pass through the elongated groove.

In one embodiment, one or more fastener openings extend through the LED substrate, and one or more fastener openings are accessible at the flat surface of the light engine slug. When the LED substrate is mounted over the flat surface of the light engine slug, the one or more fastener openings extending through the LED substrate are desirably in alignment with the one or more fastener openings accessible at the flat surface of the light engine slug. In one embodiment, one or more fasteners may be passed through the aligned fastener openings for securing the LED substrate to the flat surface of the light engine slug. The fasteners may be removed to release the LED substrate from the flat surface for maintenance, repair, upgrade and/or replacement of the LED, the LED substrate, and/or the LED driver.

In one embodiment, the landscape lighting system preferably includes a base for mounting the light fixture. In one embodiment, the base preferably has a top side and a bottom side, a centrally located support ring provided at the top side of the base, and an articulating knuckle connected with the base. In one embodiment, the articulating knuckle preferably includes a lower knuckle having a shaft, such as a cylindrical shaft, extending from a lower end thereof that is inserted into the centrally located support ring on the base for enabling 360 degree rotation of the lower knuckle relative to the base, and an upper knuckle that is rotatably mounted to the lower knuckle to enable the upper knuckle to be positioned at different angles relative to the lower knuckle. In one embodiment, the upper knuckle is rotatable about 180 degrees relative to the lower knuckle.

In one embodiment, the centrally located support ring on the base preferably has an annular wall projecting from the top side of the base, the annular wall defining an inner diameter that conforms to the cylindrical shape of shaft of the lower knuckle. The annular wall of the support ring desirably has a slot formed therein to define first and second edges on opposite sides of the slot, and a threaded opening extending through the annular wall of the support ring that is located opposite the slot. In one embodiment a threaded fastener is desirably inserted into the threaded opening of the annular wall. In one embodiment, when the lower knuckle shaft is inserted into the support ring and the threaded fastener is tightened, the threaded fastener and the first and second edges on the opposite sides of the slot exert a triangulation of locking forces on the lower knuckle shaft for preventing rotation and/or wobble of the lower knuckle relative to the base.

In one embodiment, the base preferably has three evenly space arms extending outwardly from the centrally located support ring. Each of the evenly spaced arms desirably has a fastener opening extending therethrough. In one embodiment, a bump preferably underlies and surrounds each of the fastener openings on the arms for providing an offset at the underside of the arms. The bumps have a thickness of about 0.200-0.500 inches and more preferably about 0.250 inches. In one embodiment, the fastener openings on the arms of the base are preferably internally threaded openings. In one embodiment, pins are secured to the base for mounting the base in the ground. In one embodiment, the pins have threaded upper ends, whereby the threaded upper ends of the pins may be screwed into the threaded fastener openings on the arms of the base for securing the pins to the base.

In one embodiment, the upper knuckle preferably has an upper end with an inner support ring and an outer support ring that surrounds the inner support ring. The trailing end of the light engine slug is desirably inserted into the inner support ring of the upper knuckle. The system desirably includes a light engine slug fastener that couples the trailing end of the light engine slug with the upper knuckle, whereby the light engine slug fastener is moveable between a first position in which the light engine slug is free to rotate and move in a longitudinal direction relative to the upper knuckle and a second position in which the light engine slug is locked from rotating and moving in the longitudinal direction relative to the upper knuckle.

In one embodiment, the system preferably includes a cylindrical shroud that surrounds the light engine slug. The cylindrical shroud desirably has a leading end and a trailing end. In one embodiment, the trailing end of the cylindrical shroud is inserted into the outer support ring of the upper knuckle. The system preferably includes a cylindrical shroud fastener that couples the trailing end of the cylindrical shroud with the outer support ring of the upper knuckle, whereby the cylindrical shroud fastener is moveable between a first position in which the cylindrical shroud is free to rotate and move in a longitudinal direction relative to the upper knuckle and a second position in which the cylindrical shroud is locked from rotating and moving in the longitudinal direction relative to the upper knuckle.

In one embodiment, the landscape lighting system preferably has a cylindrical glare shield having a first end and a second end. The glare shield may have a tubular shape. In one embodiment, the first end of the glare shield desirably has a first end opening surrounded by a first edge defining a first angle, and the second end of the glare shield has a second end opening surrounded by a second edge defining a second angle that is different than the first angle. In one embodiment, the first angle is about 45 degrees and the second angle is about 25 degrees.

In one embodiment, the glare shield is reversible so that either the first end or the second end of the cylindrical glare shield may be slid over the leading end of the cylindrical shroud for selecting the angled edge of the glare shield that projects beyond the leading end of the cylindrical shroud. In one embodiment, the inner diameter of the glare shield closely matches the outer diameter of the leading end of the cylindrical shroud. In one embodiment, a glare shield fastener may be used for securing the glare shield to the cylindrical shroud. The glare shield fastener may be a thumb screw. The inner surface of the glare shield may have a flat, non-reflective coating.

In one embodiment, the present invention discloses a lighting system having a set of interchangeable optics or light diverting elements that are positioned over an LED light source. Each interchangeable optic may have a specific light beam spread such as 12 degrees, 24 degrees, 36 degrees and 60 degrees. In one embodiment, the optics may create a rectangular optical light spread such as a 15 degree×30" rectangular optical pattern or at the designer's discretion no optic element may be used so that a general wash of light can be created.

In one embodiment, guide pins are utilized to mount an optic to an LED support so as to center and accurately align the optic over the LED support without requiring a screw driver, clips, retainer rings and the like. In one embodiment, from a set of optics having different beam angle spreads, the installer chooses one optic having the desired beam angle, and slides the optic over guide pins. The outer diameters of the respective guide pins preferably closely match the guide pin openings on the optic to provide a friction fit between the optic and the guide pins. The guide pins hold the optic in place, centered over the LED light source.

Unlike many currently available LED directional lights on the market today, the lighting systems disclosed herein enable an installer to remove the LED driver and LED light source and optics for service, upgrade, retrofit and/or or repair. The above-listed components are assembled into the light engine slug. The LED driver is connected to a light intensity controller and a power source using a plug connector, such as a pin style socket and plug connector for easy installation and removal. Electrical connection may also be made using a crimp and heat shrink or other electrical connections. The light engine slug preferably acts as a thermally conductive heat sink to remove the heat generated by the LED and the LED driver.

In one embodiment, the shroud is made of hard tempered copper pipe. The copper pipe preferably has an inside diameter that fits within 0.010" of an inch clearance with a 0.002"+ or − tolerance of the light engine slug, which allows thermal conductance and heat dissipation to the ambient air. Bleeding off of heat is critical to the life of an LED. The close tolerances between the shroud and the light engine slug along with the use of thermal grease preferably insures the bleed off of heat generated by the LED light source. In addition, a thermal heat dissipating path is formed between the light engine slug and the upper knuckle.

In one embodiment, the light engine slug may be rotated 360 degrees relative to the upper knuckle. Once an installer decides to use a rectangular, oval or other optic pattern that is not circular, there may be a need to adjust the light pattern so that it is aligned with a desired lighting objective. In one embodiment, the light engine slug fits into an opening at the upper end of the upper knuckle. Once a set screw is loosened, the light engine slug is freely rotatable 360 degrees. Once the light pattern generated by the optic is in alignment with the desired light pattern, the installer tightens the set screw to lock the light engine slug in place to prevent further rotational or longitudinal movement of the light engine slug relative to the upper knuckle. The installer may then secure the shroud and lens cover over the light engine slug.

In one embodiment, the light engine slug has a wire channel extending along the longitudinal axis thereof that allows the conductive wires from the LED board to nest, tucked away from potential damage that could be caused when the shroud passes over the light engine slug. The wire channel or elongated groove is preferably formed in the outer surface of the light engine slug during casting of the part, which eliminates the significant costs and time requirements associated with tooling operations.

In one embodiment, the lighting systems disclosed herein enable an installer to easily adjust the light intensity level of the LED. Adjustability of the light intensity level is important to achieve the correct lighting illumination level according to the particular needs of the lighting job. The ability to selectively adjust the light intensity level using LED's is a significant improvement over conventional halogen lights or newer LED MR-16 Replacement lamps that have a fixed light intensity level (e.g., 10 watt, 20 watt, 35 watt, 50 watt halogen or LED equivalents).

In one embodiment, a lighting system utilizes a quick connect, such as a snap together pin and socket style electrical connector or a pin connector feature that attaches directly at the base of the directional lighting fixture on the body of the fixture or as integral part of a multi-strand wire contained in a single jacketed wire that both provides the voltage to the LED driver and also provides the wires for connection to the light intensity controller. This dimming feature may also be achieved using a wireless interface, signal over power or infrared style communication. In one embodiment, the quick connect plug and/or wires associated therewith may have a reflective or glowing strip so that an installer may locate the connection with a flashlight at night, which can then be removed or kept in place after installation.

In one embodiment, the quick connect electrical connector attaches to a hand held light intensity controller. The light intensity controller preferably allows the designer to raise or lower the light intensity level of the LED by simply holding down a push button located on top of the controller. In one embodiment, the controller cycles from low light intensity to high light intensity while the button is depressed. In addition to the push button feature, the light intensity controller may be fitted with an illuminated series of LED miniature lights that make up a scale starting at the lowest level, e.g., 1, and going up to the highest light level setting, e.g. 10. The visible scale allows the designer to set the light intensity level by simply releasing the button once the desired light level is achieved. Once the light level is set, the LED driver remembers the selected light level for the life of the light fixture. The setting may be changed at any time during the life of the system. After the light level has been selected, the light intensity controller may be disconnected from the light fixture and a cap, such as a simple waterproof cap, may be placed over the quick connector to protect the connection from dirt, debris and moisture. The capped connector may be buried at the base of the fixture or placed in a location or orientation desired by the installer. The light intensity controller may then be used on other light fixtures. The above-described process may be repeated for all of the light fixtures on the property, e.g., the designer selects and uses an optic having a specific beam spread and the designer adjusts the light level of the LED light.

In one embodiment, the light intensity controller enables installers to adjust the light level during the day and not have to wait until the evening when it is dark and difficult to attach the quick connect and navigate the property without tripping over plants and possibly damaging the property. The LED scale readout on the controller eliminates this design and installation problem.

In one embodiment, a designer may select extremely low levels of light and a very wide 60 degree beam spread to wash back yard turf and plant spaces with low evenly dispersed transition down or moon lighting. The moon lighting allows the client's eyes to easily move across the landscape, easily transitioning from one lighting scene to another. The designer illuminates a planting bed with varying plant material and landscape design elements using a slightly higher light intensity level and a 36 degree beam spread to illuminate the foreground of small 18" or so plant material. With medium sized plant material, the designer might choose a 24 degree beam spread and position several fixtures at an even higher light level. For the back most and largest screening plant material, the designer may choose the highest light level and a 60 or 36 degree beam spread. Using the above-described techniques, as an observer's eyes move from front to back, the lighting scene proceeds from very low light in the foreground, to low, to medium, and to bright light at the furthest back point in the design. This lighting pattern allows the individual's eye to define both the depth and scale of the space that is being illuminated. In one embodiment, the designer may also use higher light levels to direct the viewer to other parts of the landscape such as a secret garden, sitting area, pond, waterfall, pathway, statuary, bird bath, etc.

The above example illustrates the importance of light beam spread and light intensity control that is required to achieve the desired lighting effects a lighting designer requires when designing a lighting system.

In one embodiment, the interchangeable light diverting elements and the broad range of adjustable light intensity levels enable a single light fixture to be extremely versatile with dozens or even hundreds of different light patterns and intensity level combinations. In one embodiment, different LEDs and interchangeable colored lenses may be used to create even more combinations of light displays.

In one embodiment, the vast range of beam angles and intensity settings allows distributors of the lighting systems and light fixtures disclosed herein to eliminate hundreds of Stock Keeping Units (SKU's) and eliminates the need for large standing inventory, which increases the turn and earn ratio of inventory and increases profits for distributors.

In one embodiment, the light intensity may be adjusted as follows: An installer makes final brightness light level adjustments to a lighting design. Typically, this involves adjusting the light level of the final design once all the beam angle spreads have been selected. During adjustment of the light intensity level, the installer may decide to raise the light level and then decide to lower the level until the exact light level is met according to the specific artistic taste, design, features, and aesthetic required for the particular lighting scene by the designer. When the button is pressed again, the direction of the light change reverses direction. If the installer was increasing the light level and it was a bit too bright, by letting off the button and then pressing the button again, the controller reverses direction and starts dimming the lighting fixture. This allows the installer to narrow in on the exact light level required. This saves a large amount of time for the designer since other methods of light intensity adjustment require cycling through from low to high and back down to low, which is a difficult method to use for setting a light level because it is difficult for the human eye to properly gauge. The "narrow down" feature disclosed herein allows the designer to narrow down the light level setting to exactly reach the brightness required for the particulars required on the site.

In one embodiment, the light fixture has a reversible glare shield that slides over the shroud, which is an improvement to a conventional design that has existed for many years in the industry. In one embodiment, the reversible glare shield have different angles cut at both ends to allow an installer to flip the glare shield over to select the cut off glare reduction that works best for the application. In one embodiment, in order to minimize light reflection and the reflected light that bounces off the inside of the glare shield, no-gloss coating, such as a TEFLON PTFE black matte no-gloss coating may be applied to the inside surface of the glare shield to reduce glare. The glare shield preferably includes a set screw that allows the installer to set the height (i.e., longitudinal adjustment) and rotational direction of the glare shield (0-360 degrees) on the shroud.

In one embodiment, a lighting system preferably includes a light fixture having a base with a wire slot that enables power and/or control wires to pass through the wire slot for fast attachment and/or detachment from the base. The wire slot feature eliminates the need to feed power and control wires for the light fixture through a hole in the stake. In one embodiment, the base desirably uses a socket and set screw attachment method for fixing the knuckle to the base, which allows the designer a full 360 degree rotational adjustment and uses a set screw to secure both the knuckle and the base together. Conventional methods use a threaded IPS connection which twists the wire and causes strain inside the fixture possibly leading to wire damage.

In one embodiment, the base preferably has ground mounting pins attached thereto. In one embodiment, the base has three ground mounting pins that may be pressed into the ground or soil. In one embodiment, each of the three pins has a threaded upper end that screws into threaded openings provided on outwardly extending arms of the base. The threaded openings preferably pass completely through the arms of the base. If desired, an installer may remove the pins and use the threaded openings in the arms of the base to mount the base onto a surface using standard wood screws, lag bolts or other hardware suitable for the application. In one embodiment, the installer may drill holes in the arms of the base to accommodate larger diameter mounting hardware, if necessary. In one embodiment, the base is made of raw, un-coated Bronze alloy 85-5-5-5 metallurgy, with no paint, powder coating, or sealant that may crack, peel or cause the coating of the metal to chip off or peel off when the metal is drilled by an installer and/or left exposed to the outdoor elements. In one embodiment, the base is made of bronze, which ages naturally in the outdoor elements.

In one embodiment, each of the outwardly extending arms of the base has a standoff or bump provided on an underside of the arms, which is preferably in alignment with the threaded openings of the arms. When the threaded ground-mounting pins are detached from the arms of the base, the bumps elevate the base above the underlying surface to allow the power and/or control wires to pass freely underneath the base so that the wire feeding the light fixture can enter from many directions. The elevating bumps insure the wire does not get damaged during installation when the fixture is screwed in place, such as being screwed to a flat wood or concrete surface (e.g. a deck or wall) thereby providing an installer with flexibility when wiring the light fixture to the power supply by allowing the wire to enter anywhere under the base to feed the lighting fixture. In one embodiment, the bumps have a height of about 0.250 inches.

In one embodiment, the knuckle at the lower end of the light fixture is secured to the base using a "no wobble" fastening mechanism. In one embodiment, the base has a centrally located securing ring that receives a shaft at the lower end of the lower knuckle. The securing ring of the base has a wire slot through which the power and/or control wires pass to allow the attachment of the base to the light fixture. The securing ring has two vertical edges spaced from each other on opposite sides of the wire slot to define first and second contact points. A set screw opposite the first and second contact points forms a triangulation of locking forces that causes the shaft of the lower knuckle to hit three points, not two, thus eliminating wobble between the mating of the two parts.

In one embodiment, the lighting systems includes an LED upgrade or repair feature that enables an end user or installer to upgrade and/or replace the LED that was originally installed in the light fixture. The upgrade and/or replacement may be made at any time after initial installation due to lightening, power problems (e.g., power surge), etc., which causes damage to the LED but which does not impact the LED driver. The LED may also be replaced to capture advancements in the quality of new LEDs as they become available such as energy saving advancements, color changing advancements, or yet to be discovered improvements. Most manufacturers affix the LED directly to an FR4 printed circuit board along with all of the drive circuit components, which make replacing the LED cost prohibitive since all of the electrical components are attached to one FR4 circuit board. With the rapid advancement of LED lighting technology, the lighting systems disclosed herein are specifically designed to separate the LED drive circuitry and the LED into two separate components easily allowing the LED to be removed, upgraded and/or repaired when necessary.

In one embodiment, LED upgrade and/or replacement is accomplished by removing the screws holding the LED board in place and removing the two wire splice connections that connect the LED to the LED driver. Thus, for a fraction of the price, the installer or end user can replace the LED board, that holds the LED and the light fixture can continue using the existing LED drive circuit. Although the present invention is not limited by any particular theory of operation, it is believed that this feature is beneficial due to the rapid advancement of LED technology regarding energy efficiency, the overall quality of LEDs as a light source, the improving stability of the color output, and the lower cost of LEDs. As a result, the end user can capture the benefits of new LED technology without having to discard the entire fixture. Only the LED itself needs to be replaced. In one embodiment, the LED driver may be replaced to capture new technological advancements.

In many instances, a landscape lighting designer wishes to add glare control, color correction, spread lenses and other beam, glare or color correcting lenses to a lighting fixture. In one embodiment, the optic abuts against the underside of the glass lens, which provides little or no room to add the glare control, color correction, spread lenses and other beam, glare or color correcting lenses to the light fixture. In response, in one embodiment, the present invention enables the longitudinal position of the light engine slug to be adjusted relative to the inner ring of the upper knuckle when the outer diameter OD of the light engine slug slides/nests within the inner diameter ID of the inner ring of the upper knuckle. The adjustment of the longitudinal position of the light engine slug relative to the upper knuckle may be held in place with a set screw. This particular design allows the light engine slug to drop down when the set screw is loosened to provide extra room to accommodate the thickness of an Optic, Honeycomb glare Louver, Colored Lens, Dychroic Filter and/or other color or glare correcting lens and still provide the sandwiching effect necessary to hold the optic and entire inner assembly in place. Once the extra room for the added lens or piece has been provided, the installer may tighten the set screw to again secure the light engine slug in place. Loosening the set screw also enables the installer to rotate the light engine slug 360 degrees about the longitudinal axis of the light engine slug to align a selected light pattern.

These and other preferred embodiments of the present invention will be described in more detail below.

BRIEF DESCRIPTION OF THE DRAWINGS

FIG. 3 shows a glare shield for the light fixture shown in FIG. 2.

FIG. 4 shows the glare shield and a shroud for the light fixture shown in FIG. 2.

FIG. 5A shows a set of light diverting elements for the light fixture shown in FIG. 2, in accordance with one embodiment of the present invention.

FIG. 5B shows a top plan view of one of the light diverting elements shown in FIG. 5A.

FIG. 6A shows an exploded view of a light engine slug for a light fixture, in accordance with one embodiment of the present invention.

FIG. 6B shows an assembled light engine slug and a light diverting element connectible with a leading end of the light engine slug, in accordance with one embodiment of the present invention.

DETAILED DESCRIPTION OF PREFERRED EMBODIMENTS

Figure 1:
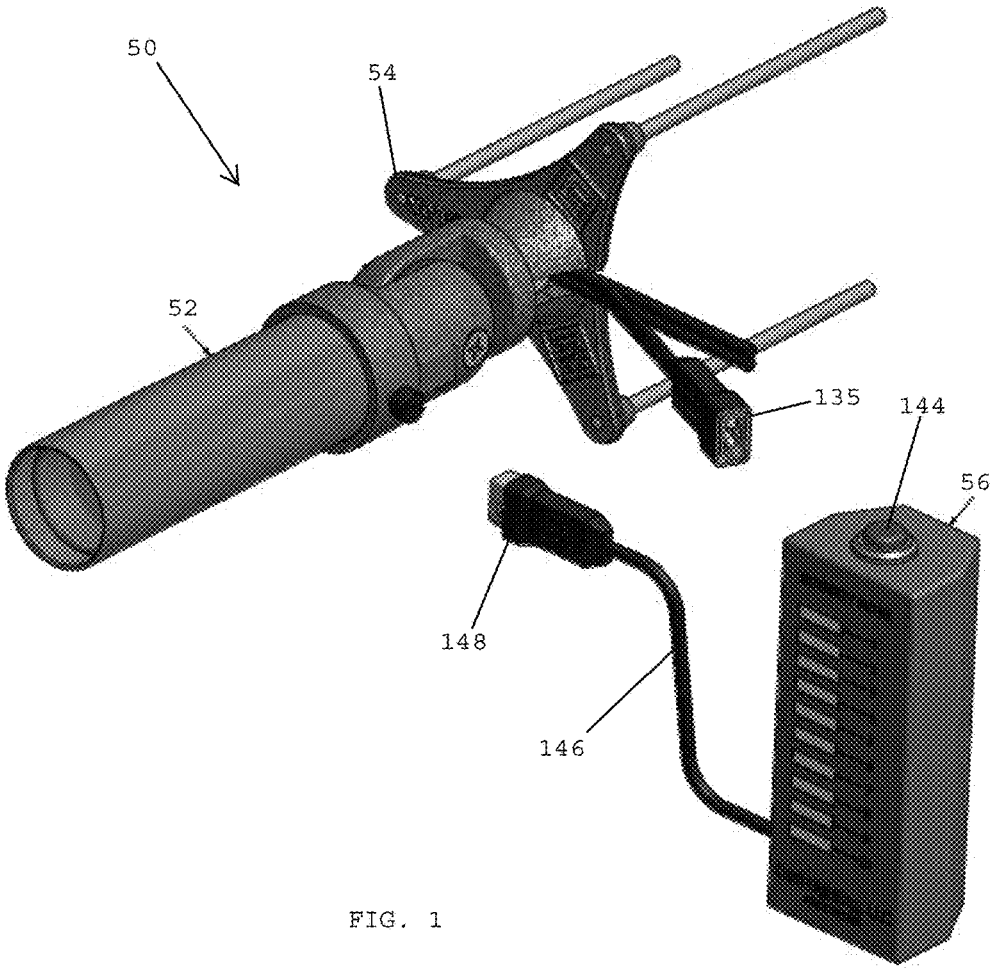
FIG. 1 shows a perspective view of a landscape lighting system including a light fixture having a base and a light intensity controller connectible with the light fixture, in accordance with one embodiment of the present invention.

Referring to FIG. 1, in one embodiment, a landscape lighting system 50 preferably includes a light fixture 52 having a base 54. The lighting system 50 desirably includes a light intensity controller 56 that may be connected with the light fixture 52 for controlling the intensity of the light generated by the light fixture.

Figure 2:
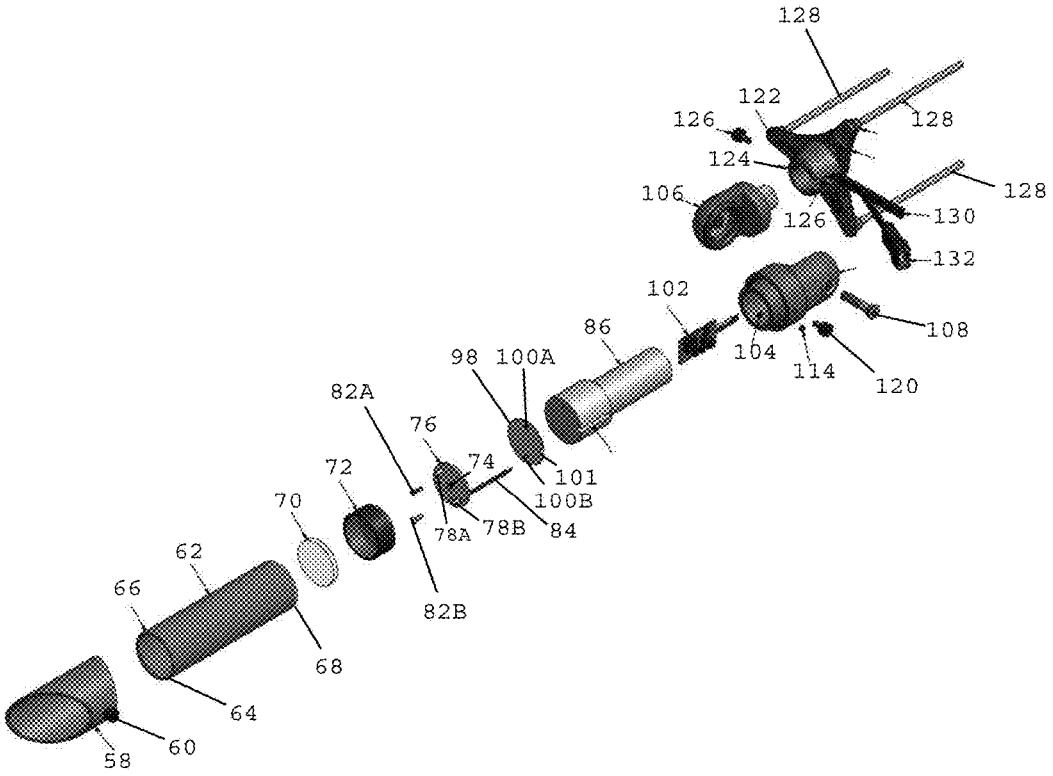
FIG. 2 shows an exploded view of the light fixture shown in FIG. 1.

Referring to FIG. 2, in one embodiment, the light fixture 52 preferably includes a glare shield 58, such as a reversible glare shield, having a rotatable thumb screw 60. The glare shield 58 is preferably made of a non-ferrous metal such as copper, aluminum, or brass. In one preferred embodiment, the glare shield 58 is made of extruded copper. In one embodiment, a non-glossy coating, such as a Teflon PTFE black matte, no-gloss coating is applied over the inside surface of the glare shield to reduce glare.

In one embodiment, the light fixture 52 desirably includes a shroud 62 having a leading end 64 with a rolled edge 66 and a trailing end 68. In one embodiment, the shroud 62 is an elongated cylinder that is made using an extruded copper.

The light fixture 52 preferably includes an optical lens 70, such as a glass lens, that is inserted inside the rolled edge 66 at the leading end 64 of the shroud 62. In one embodiment, the optical lens 70 is preferably a clear glass lens having no iron or reduced iron elements therein for providing a high quality, optical lens. In one embodiment, the optical lens 70 sits inside the opening at the leading end 64 of the shroud 62.

In one embodiment, the light fixture 52 preferably includes one or more interchangeable optics or light diverting element 72. In one embodiment, each light diverting element 72 preferably has a unique light beam angle spread, such as 12 degrees, 24 degrees, 36 degrees, and 60 degrees. The light diverting element 72 may also define a rectangular pattern of light such as a 15 degree×30 inch rectangular light pattern. As will be described in more detail below, the light diverting element 72 may be one of a plurality of light diverting elements, whereby each light diverting element has a unique light angle spread and/or rectangular optical pattern, which may be utilized by landscape lighting technicians to generate an aesthetically pleasing light pattern.

In one embodiment, the light fixture 52 desirably includes a light emitting diode (LED) 74 that is mounted on an LED support base 76, which, in turn, has a pair of guide pins 78A, 78B and a pair of screw hole openings 80A, 80B adapted to receive securing screws 82A, 82B. The light fixture also desirably includes LED wires 84 that are connected with the LED 74 for providing power to the LED and controlling the intensity of the light generated by the LED.

In one embodiment, the light fixture 52 preferably includes a housing, such as a light engine slug 86, having a leading end 88 and a trailing end 90. The leading end 88 of the light engine slug 86 desirably has a flat surface 92 that seats the LED supports base 76. The flat surface 92 preferably includes screw hole openings 94A, 94B that are aligned with the screw hole openings 80A, 80B on the LED support base 76 when the LED support base 76 is mounted onto the flat surface 92 of the light engine slug 86.

In one embodiment, the light engine slug 86 desirably includes an elongated groove 96 that extends from the flat surface 92 at the leading end 88 toward the trailing end 90 and along the longitudinal axis of the light engine slug. The elongated groove 96 is adapted to receive the LED wires 84 to avoid damage of the LED wires, such as when the shroud 62 slides over the light engine slug.

In one embodiment, the light fixture 52 preferably includes a thermally conductive pad 98 that generally conforms to the shape of the LED base 76 and the shape of the flat surface 92 of the light engine slug 86. The thermally conductive pad 98 preferably includes a pair of screw hole openings 100A, 100B that are desirably aligned with the screw hole openings 94A, 94B on the flat surface 92 of the light engine slug 86. The thermally conductive pad 98 desirably has a notch 101 (for the LED wires 84) that is aligned with the groove 96 when the pad 98 is positioned on the flat surface 92.

In one embodiment, the light fixture 52 preferably includes an LED driver 102 that is disposed within the body of the light engine slug 86. The LED driver 102 is preferably electrically interconnected with the LED 74 via the LED wires 84 for providing power to and controlling operation of the LED. In one embodiment, the LED driver 102 is inserted into an opening at the trailing end 90 of the light engine slug 86.

In one embodiment, the light fixture 52 preferably includes an upper knuckle 104 and a lower knuckle 106. In one embodiment, a threaded screw 108 is utilized for connecting the upper knuckle with the lower knuckle. In one embodiment, the upper knuckle 104 may be rotated to a range of angles (e.g. 0-180 degrees) relative to the lower knuckle. Once a desired angle has been selected, the upper knuckle 104 is locked in place by tightening the threaded screw 108.

In one embodiment, the upper knuckle 104 includes an inner ring 110 adapted to receive the trailing end 90 of the light engine slug 86. The inner ring 110 has a set screw opening 112 passing therethrough. A set screw 114 may be inserted into the set screw opening 112 and tightened for holding the light engine slug 86 inside the inner ring 110.

The upper knuckle 104 desirably includes an outer ring 116 that is adapted to receive the trailing end 98 of the shroud 62. The outer ring 116 preferably includes a screw hole opening 118 adapted to receive a thumb screw 120. When the trailing end 68 of the shroud has been inserted into the outer ring 116, the shroud 62 may be rotated 360 degrees within the outer ring 116. When a desired angle of rotation has been obtained, the thumb screw 120 may be tightened for preventing further rotation of the tube 62 relative to the outer ring 116.

In one embodiment, the light fixture 52 preferably includes a base 122 having a central opening 124 provided at a top side thereof that is adapted to receive a shaft 126 projecting from a trailing end of the lower knuckle 106. The shaft 126 may have a cylindrical outer surface. The light fixture 52 desirably includes a lower knuckle thumb screw 126 that may be tightened for securing the shaft 126 of the lower knuckle 102 to the base 122. The base 122 desirably includes threaded pins 128 that may be threaded into openings provided at the outer ends of the arms of the base 122.

The base 122 preferably includes a power cord 130 and a light intensity controller connector 132 that may be used for connecting the light fixture 52 to a light intensity controller as will be described in more detail below.

In one embodiment, the light fixture has thermally conductive parts that are in contact with one another for drawing heat away from the LED 74 for maximizing the life of the LED. In one embodiment, heat generated by the LED 74 passes through the LED support base 76 and the thermally conductive pad 98 for being transferred to the light engine slug 86. In turn, the light engine slug 86 is in contact with the upper knuckle 104 for transferring heat to the upper knuckle. In one embodiment, the trailing end of the shroud 62 is thermally coupled with the upper knuckle 104 for passing heat to the upper knuckle. The thermally conductive parts may be made of metal.

Referring to FIGS. 3 and 4, in one embodiment, the glare shield 58 is a reversible glare shield having a tubular body 140 defining an inner diameter that is slightly larger than the outer diameter of the shroud 62. The body 140 of the glare shield 58 preferably has a length $L_1$ that extends from a first end to a second end of the glare shield. In one embodiment, the length $L_1$ is about 3-4 inches and more preferably about 3.5 inches. In one embodiment, the first end of the glare shield 58 defines an angle $\alpha_1$ and the second end of the glare shield defines an angle $\alpha_2$ that is smaller than $\alpha_1$. Thus, the glare shield 58 has angled cuts on both ends that are different for allowing a landscape lighting designer to flip the glare shield 58 over to select the cutoff angle for glare reduction that works best for a particular lighting application. The set screw 68 enables the landscape lighting designer to set both the rotational direction of the glare shield 58 from 0-360 degrees and the height of the glare shield on the shroud 62.

Referring to FIG. 4, in one embodiment, the body 140 of the glare shield 58 slides over the leading end 64 of the shroud 62. In the particular embodiment shown in FIG. 4, the second end of the glare shield 58 with the second angle $\alpha_2$ is the end of the glare shield 58 that is slid over the outer surface of the shroud 62. Until the thumb screw 60 is tightened, the glare shield 58 may be rotated 360 degrees around the outer surface of the shroud 62 and the glare shield may move telescopically along the longitudinal axis of the shroud. Once the glare shield has been rotated into a desired direction relative to the shroud 62 and/or moved into a desired longitudinal position relative to the tube, the thumb screw 60 is preferably tightened for preventing further rotation of the glare shield 58 relative to the shroud 62.

In one embodiment, the landscape lighting designer may flip the orientation of the first and second ends of the glare shield 58 so that the first end of the glare shield with the sharper angle $\alpha_1$ slides over the outer surface of the shroud 62. A light designer may make similar adjustments as noted above and then tighten the thumb 64 preventing further rotation and/or longitudinal movement of the glare shield 58 relative to the shroud 62.

Referring to FIG. 4, in one embodiment, the first end 64 of the shroud 62 preferably includes a rolled edge 66 that is adapted to receive and seat the optical lens 70 shown and described above in FIG. 2. In one embodiment, an interior rim or groove may be formed within the first end 64 of the shroud 62 for seating an optical lens. In one embodiment, the leading end 64 of the shroud 62 may also seat a colored lens in addition to an optical lens for modifying the color of the light emanating from the light fixture.

Referring to FIG. 5, in one embodiment, a lighting system preferably includes a plurality of interchangeable optics or light diverting elements 72A-72D that produce different light beam angle spreads. In the particular embodiment shown in FIG. 5, the plurality of light diverting elements include a first optic 72A that is designed to generate a light beam angle spread of 12 degrees, a second optic 72B that is designed to produce a light beam angle spread of 24 degrees, a third optic 72C that is designed to produce a light beam angle spread of 36 degrees, and a fourth optic 72D that is designed to produce a light beam angle spread of 60 degrees. Although only four light diverting elements 72A-72D are shown in FIG. 5, other embodiments may have fewer or more light diverting elements for producing a different range of light beam angle spreads. The exact number and the specific light beam angle spreads produced by the light diverting elements may be modified as necessary to meet various lighting needs. In one embodiment, one or more of the light diverting elements 72A, 72D may include a colored lens covering a leading end thereof. The colored lens desirably produces light having a particular color. In one embodiment, a lighting system may include a plurality of light diverting elements, whereby each light diverting element has a different colored lens.

Referring to FIG. 5B, in one embodiment, each light diverting element 72 includes a pair of guide pin openings 73A, 73B that are adapted to receive the guide pins 78A, 78B provided on the LED base 76 (FIG. 2). In one embodiment, the inner diameter of the guide pin openings 73A, 73B closely match the outer diameters of the guide pins for providing a friction fit between the light diverting element 72 and the guide pins 78A, 78B provided at the leading end of the light engine slug, as will be described in more detail herein.

Referring to FIGS. 6A and 6B, in one embodiment, the LED 74 provided on the LED support base 76 is secured to the flat surface 92 at the leading end of the light engine slug 86. Referring to FIG. 6A, in one embodiment, the thermally conductive pad 98 is positioned over the flat surface 92 of the light engine slug 86 so that the screw hole openings 100A, 100B on the thermally conductive pad 98 are aligned with the screw hole openings 94A, 94B on the flat surface 92 of the light engine slug 86, and so that the notch 101 provided at the outer periphery of the thermally conductive pad 98 is aligned with the elongated groove 96 that extends along the longitudinal axis of the light engine slug 86.

In one embodiment, after the thermally conductive pad 98 is seated atop the flat surface 92 of the light engine slug 86, the LED support 76 base is seated over the thermally conductive pad with the LED wires 84 passing through the notch 101 in the thermally conductive pad and the elongated groove 96 formed in the light engine slug 86. The securing screws 82A, 82B are passed through the screw openings 80A, 80B of the LED base 76 and the screw hole openings 1000A, 100B on the thermally conductive pad 98 for securing the LED base 76 to the flat surface 92 at the leading end of the light engine slug 86.

FIG. 6B shows the light engine slug 86 after securing screws 82A, 82B have been used to secure the LED base 76 to the flat surface 92. The light diverting element 72 is then secured over the LED 74 by sliding the pair of guide pin openings 73A, 73B (FIG. 5B) formed in the light diverting element over the pair of guide pins 78A, 78B provided on the LED base 76. The LED wires 84 are desirably seated within the elongated groove 96 formed in the outer surface of the light engine slug 86 to protect the LED wires from damage. Although not shown in FIG. 6B, the outer wall of the light engine slug 86 may include one or more openings that enable the LED wires 84 to pass therethrough for being electrically interconnected with the LED driver 102 (FIG. 2) disposed inside the light engine slug 86.

Figure 7C:
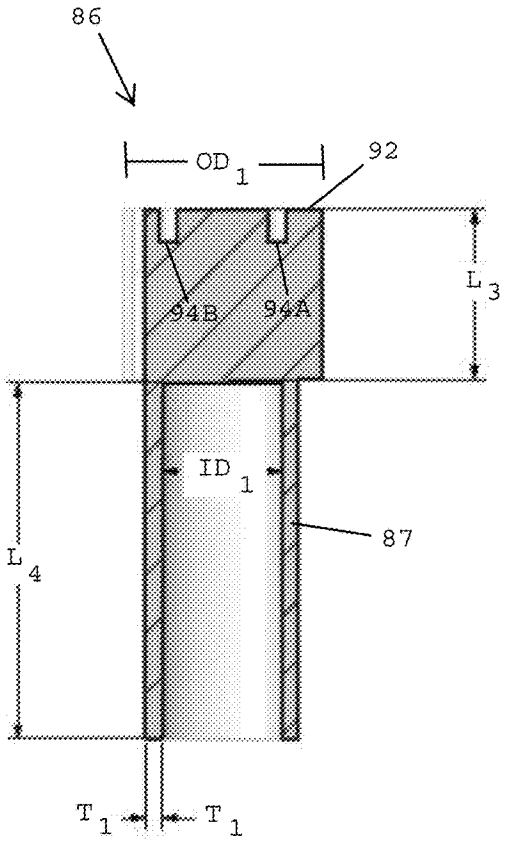
FIGS. 7A-7C show a light engine slug, in accordance with one embodiment of the present invention.
Figure 7B:
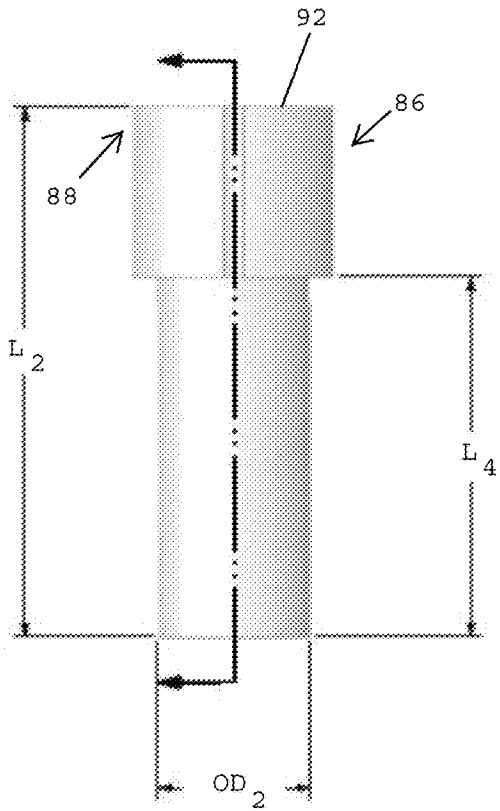
Figure 7A:
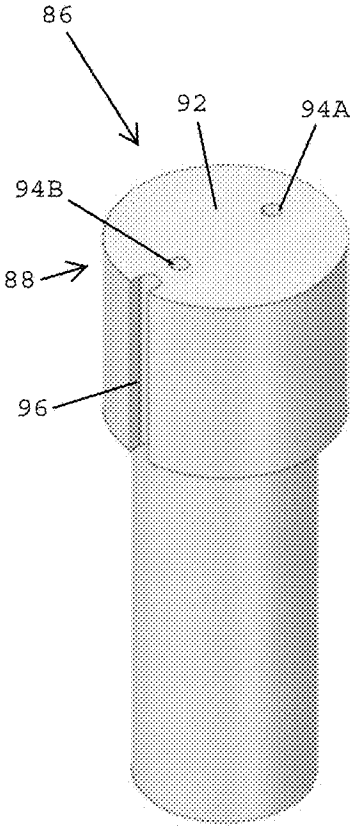

FIGS. 7A-7C show a light engine slug 86, in accordance with one preferred embodiment of the present invention. The light engine slug 86 is preferably made of metal. Referring to FIG. 7A, in one embodiment, the light engine slug includes the flat surface 92 at the leading end 88 thereof and screw hole openings 94A, 94B formed in the flat surface 92. The light engine slug 86 includes an elongated groove 96 extending along the longitudinal axis thereof. The elongated groove 96 is accessible at the periphery of the flat surface 92 and is adapted to receive the LED wires 84 (FIG. 2) for providing power to and control of the LED.

Referring to FIGS. 7B and 7C, in one embodiment, the light engine slug 86 has a length $L_2$ of about 3.9 inches. The light engine slug 86 has a larger diameter leading end having a length $L_3$ of about 1.250 inches and a reduced diameter trailing end having of length $L_4$ of about 2.625-2.650 inches. The larger diameter leading end has an outer diameter $OD_1$ of about 1.480 inches, and the smaller diameter trailing end has an outer diameter $OD_2$ of about 1.125 inches.

Referring to FIG. 7C, in one embodiment, the smaller diameter trailing end of the light engine slug 86 is hollow and is adapted to receive the LED driver 102, shown above in FIG. 2. In one embodiment, the outer wall 87 of the smaller diameter trailing section has a tubular shape and a thickness $T_1$ of about 0.125 inches. The tubular shaped wall 87 defines an inner diameter $ID_1$ of about 0.875 inches.

Figure 8A:
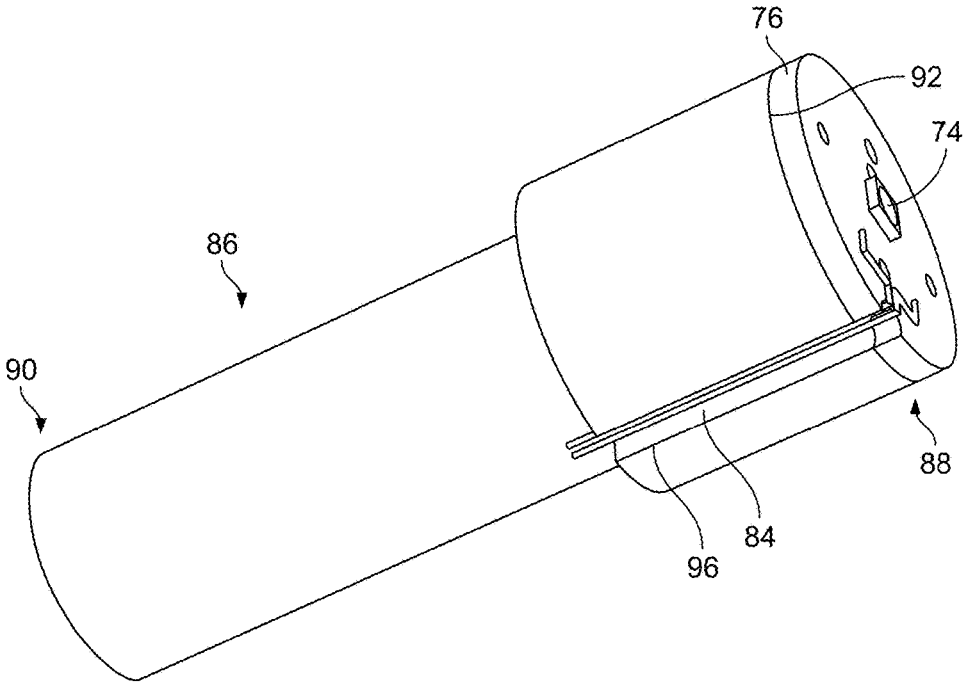
FIG. 8A shows a perspective view of a light engine slug and an LED support base secured over a flat surface at a leading end of the light engine slug, in accordance with one embodiment of the present invention.

Referring to FIG. 8A, in one embodiment, an LED base 76 having an LED 74 mounted thereon is disposed over the flat leading face 92 provided at the leading end 88 of the light engine slug 86. The LED wires 84 are disposed within the elongated groove 96 formed in the larger diameter leading end of the light engine slug.

Figure 8B:
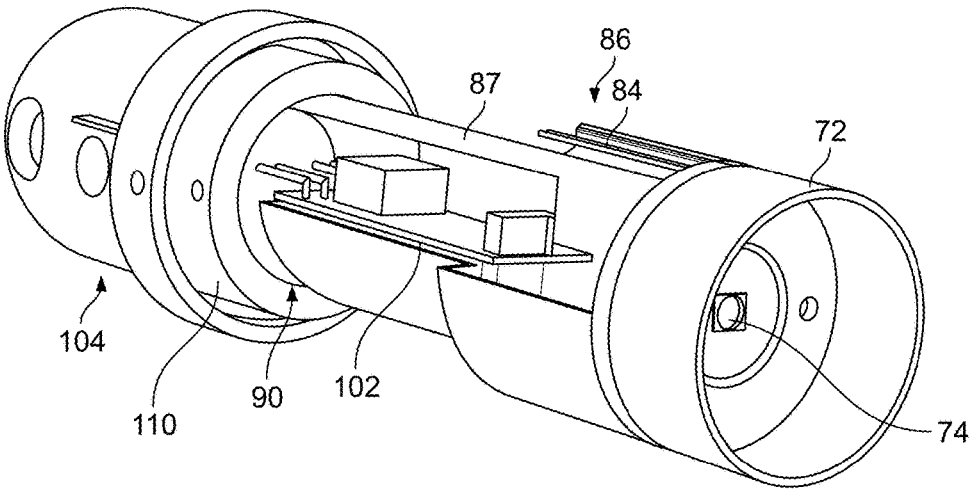
FIG. 8B shows the light engine slug of FIG. 8A with a leading end coupled with a light diverting element and a trailing end coupled with an upper knuckle of a light fixture, in accordance with one embodiment of the present invention.

Referring to FIG. 8B, in one embodiment, the LED wires 84 are preferably electrically interconnected with an LED driver 102 disposed within the inner chamber of the smaller diameter trailing section of the light engine slug 86. In one embodiment, the LED wires 84 preferably pass through an opening in the outer wall 87 of the smaller diameter section of the light engine slug 86. The trailing end 90 of the light engine slug 86 is preferably inserted into the inner ring 110 of the upper knuckle 104. Power and/or control for the LED driver 102 may be provided through conductive wires that pass through the upper knuckle 104.

In one embodiment an optic or light diverting element 72 having a particular light beam angle spread may be secured over the LED 74. In one embodiment, a plurality of light diverting elements having different light beam angle spreads may be utilized for modifying the angle of the light propagating from the LED 74. In one embodiment, the light diverting element 72 may include a colored lens covering the leading end of the optic for providing colored light that is different than the light generated by the LED 74.

Figure 9:
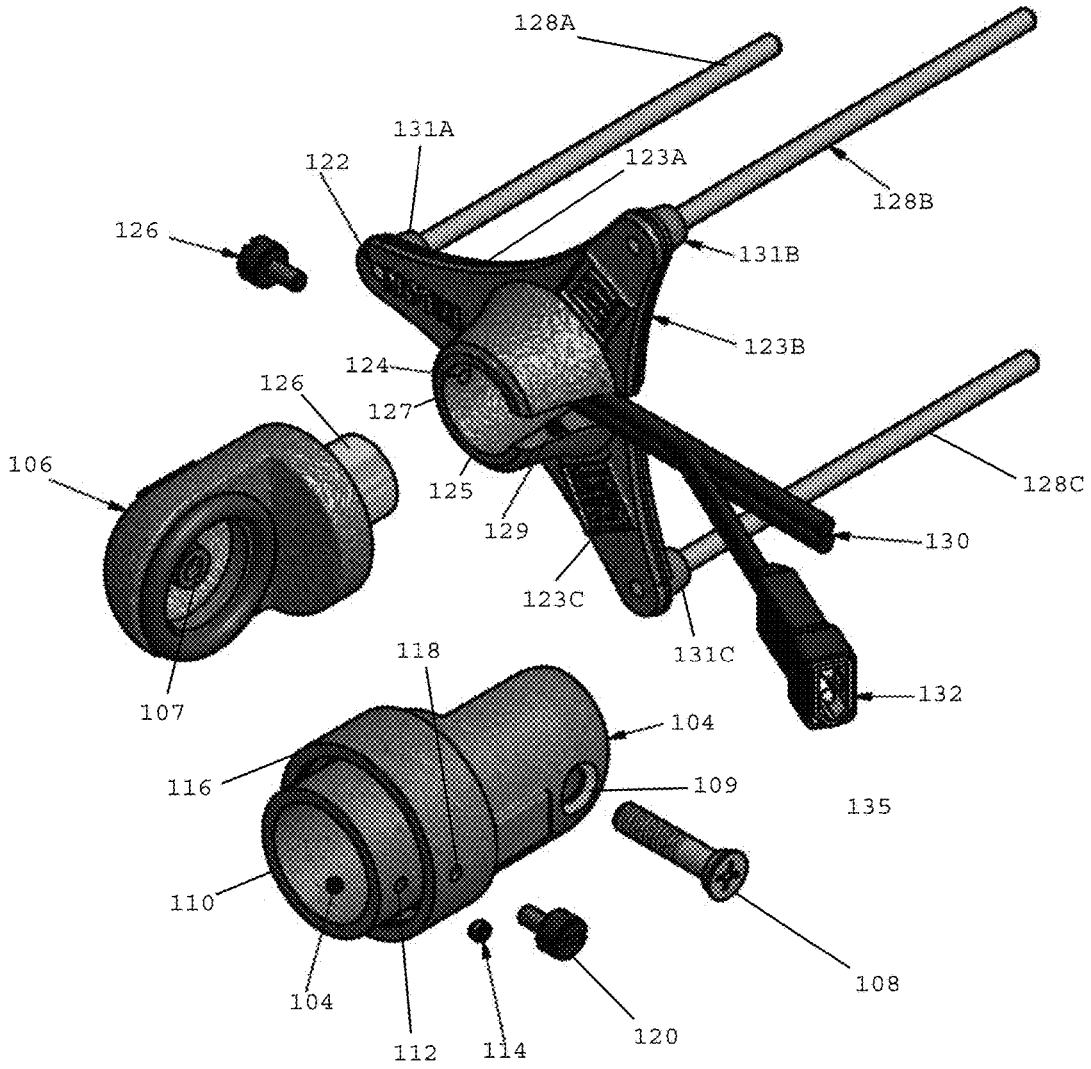
FIG. 9 shows an exploded view of an upper knuckle, a lower knuckle, and a base of a light fixture, in accordance with one embodiment of the present invention.

Referring to FIG. 9, in one embodiment, the light fixture 52 preferably includes the upper knuckle 104 that is rotatably mounted to the lower knuckle 106. The upper knuckle 104 includes the inner ring 110 defining an inner opening that is adapted to receive a trailing end of the light engine slug 86 (FIG. 2). The inner ring 110 includes a set screw opening 112 adapted to receive the set screw 114. In one embodiment, the trailing end of the light engine slug is inserted into the inner opening defined by the inner ring 110. The body of the light engine slug may be rotated 360 degrees within the inner opening defined by the inner ring 110. The light engine slug may also move longitudinally relative to the upper knuckle 104. When a landscape lighting technician has rotated the light engine slug to a particular desired position relative to the inner ring 110, or adjusted the longitudinal position of the light engine slug relative to the upper knuckle, the set screw 114 may be tightened for preventing further rotation of the light engine slug.

The upper knuckle 104 also preferably includes the outer ring 116 defining a second opening adapted to receive the trailing end 68 of the shroud 62 (FIG. 2). The outer ring 116 includes an outer ring thumb screw opening 118 adapted to receive the upper knuckle thumb screw 120. In one embodiment, when the trailing end 68 of the shroud 62 (FIG. 2) is inserted into the outer opening defined by the outer ring 116, the thumb screw 120 may be tightened for preventing longitudinal or rotational movement of the shroud 62 relative to the upper knuckle 104.

In one embodiment, the upper knuckle 104 is coupled with the lower knuckle 106 by passing a threaded screw 108 through an opening 109 in the upper knuckle 104 and into a threaded opening 107 provided on the lower knuckle 106. After the threaded screw 108 couples the upper and lower knuckles together, and as long as the threaded screw 108 is not fully tightened, the upper knuckle 104 may be rotated relative to the lower knuckle 106. As a result, a landscape lighting technician may rotate the upper knuckle 104 to a wide range of angles relative to the lower knuckle 106. When a desired angle for the upper knuckle 104 has been attained, the threaded screw 108 may be tightened for locking the angle of the upper knuckle 104 relative to the lower knuckle 106.

In one embodiment, the trailing end of the lower knuckle 106 has a shaft 126. In one embodiment, the shaft 126 preferably has cylindrical shape that is insertable into a central opening 125 provided at a top side of the base 122. The central opening 125 is defined by an outer wall 127 having a threaded opening 124 extending therethrough. A threaded thumb screw 126 is insertable into the threaded opening 124. The outer wall 127 of the base 122 has a wire slot 129 formed therein that enables a power cord 130 and a light intensity controller cord 132 to pass therethrough.

The power cord 130 preferably provides power to the LED driver 102 (FIG. 2) and the LED 74 (FIG. 8A) disclosed herein. The light intensity controller cord 132 preferably includes a connector 135, such as a plug, that enables the controller cord 132 to be electrically interconnected with a light intensity controller 56 (FIG. 1) as will be described in more detail herein for controlling the intensity of the light generated by an LED.

In one embodiment, when the cylindrical shaft 126 of the lower knuckle 106 is inserted into the central opening 125 defined by the outer wall 127 of the base 122, the lower knuckle 106 may be rotated 360 degrees within the opening 125. When a desired angle of rotation has been attained, the thumb screw 126 may be tightened for preventing further rotation of the cylindrical shaft 126 of the lower knuckle 106 within the central opening 125.

Figure 10:
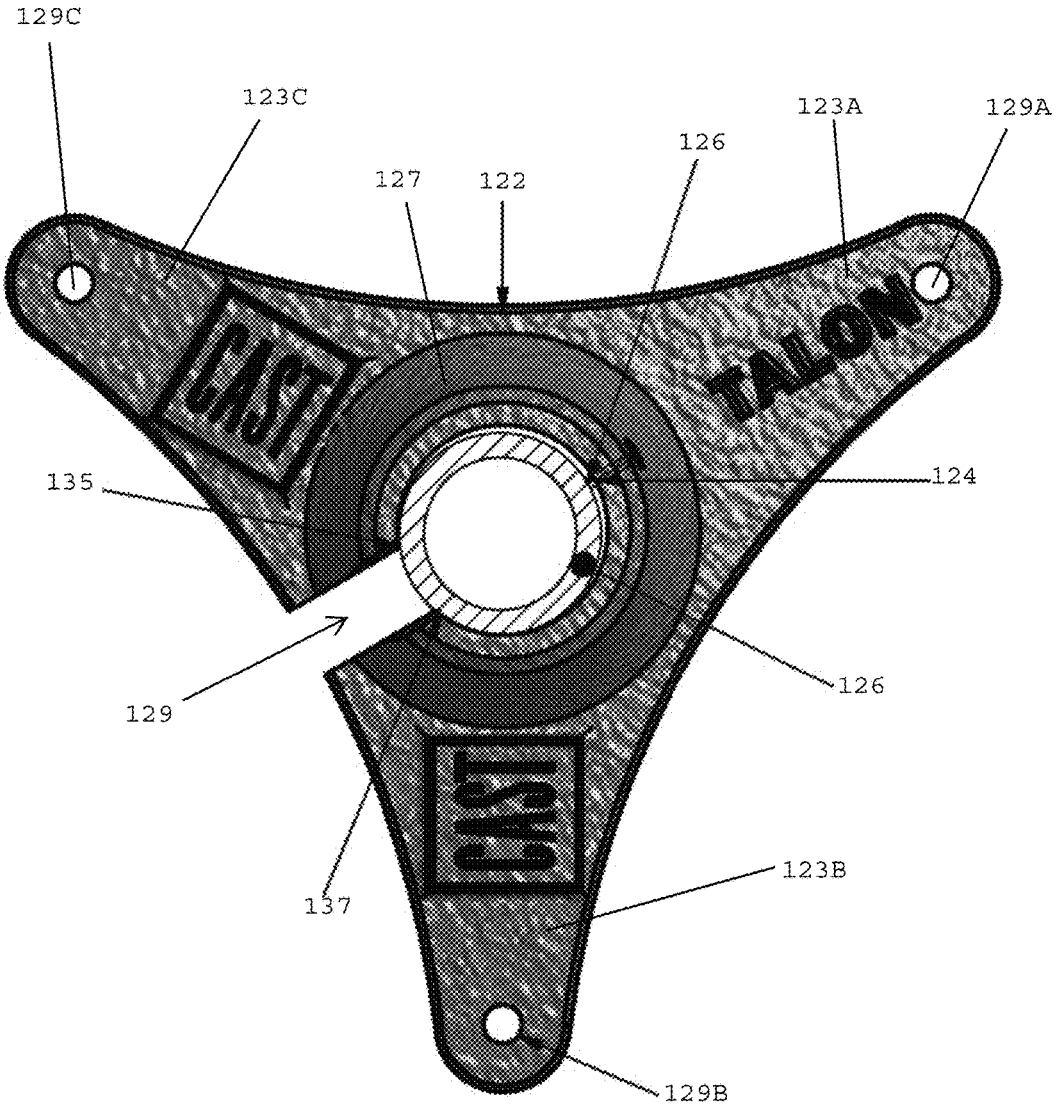
FIG. 10 shows a top plan view of the base shown in FIG. 9.

Referring to FIGS. 9 and 10, in one embodiment, the base 122 preferably includes three arms 123A-123C that project outwardly from the central opening 125. Each of the arms 123A-123C has outer ends with respective threaded openings 129A-129C adapted to receive threaded pins 128A-128C. In one embodiment, the lower ends of the threaded pins 128A-128C may be inserted into the ground for anchoring the base 122 to the ground.

Referring to FIG. 9, in one embodiment, the outer ends of the arms 123A-123C have pads 131A-131C provided on an underside of each arm. In certain embodiments, the threaded pins 128A-128C may not be utilized and the pads 131A-131C may be abutted against a mounting surface such as a wall or support beam. The pads space the underside of the base 122 away from the underlying flat surface so that the power cord 130 and/or the controller cord 132 may pass beneath the base without being pinched and/or damaged.

Referring to FIG. 10, in one embodiment, the base 122 includes the three outwardly extending arms 123A-123C and the outer wall 127 defines the central opening 125 adapted to receive the cylindrical shaft 126 of the lower knuckle 106 (FIG. 9). The outer wall 127 preferably includes a thumb screw opening 124 adapted to receive a thumb screw 126. The thumb screw 126 may be passed through the thumb screw opening 124 and tightened for abutting against the outer surface of the cylindrical shaft 126 of the lower knuckle.

The outer wall 127 that defines the central opening 125 of the base 122 desirably includes a wire slot 133 formed therein that defines a first contact point 135 and a second contact point 137. The power cord 130 and the light intensity controller cord 132 preferably pass through the wire slot 133. The two contact points 135, 137 define two vertically extending edges spaced from one another on opposed sides of the wire slot 133. The set screw 126 preferably opposes the two contact points 135, 137. As a result, the shaft 126 of the lower knuckle is subjected to a triangulation of locking forces whereby the shaft 126 is locked at three points of contact rather than two points of contact thus eliminating wobble between the cylindrical shaft 126 of the lower knuckle 106 (FIG. 9) and the base 122.

Figure 11:
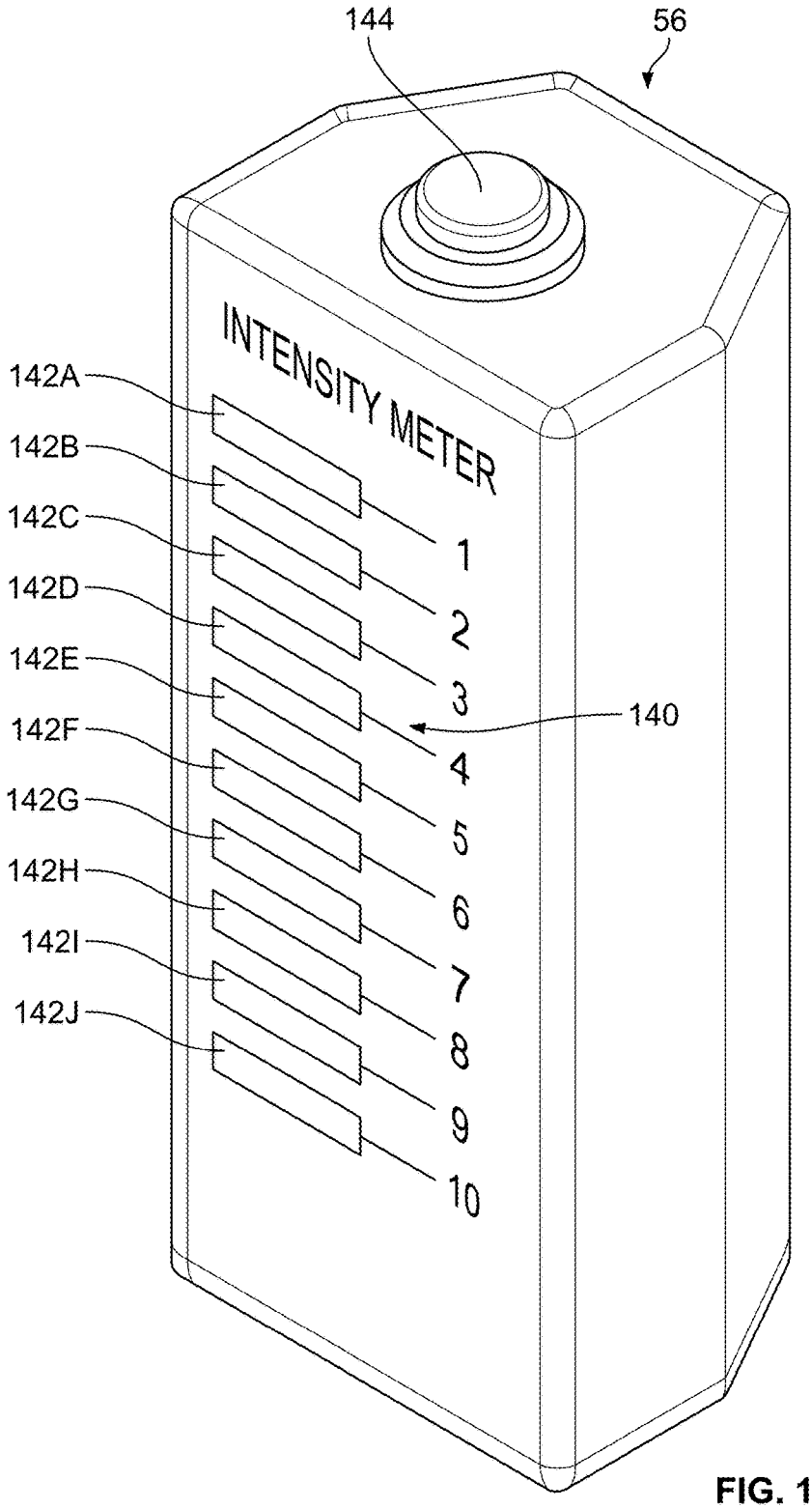
FIG. 11 shows a perspective view of a light intensity controller for a landscape lighting system, in accordance with one embodiment of the present invention.

Referring to FIGS. 1 and 11, in one embodiment, a landscape lighting system preferably includes a light intensity controller 56 that enables a landscape lighting technician to control the intensity of the light emanating from the LED 74 (FIG. 2). The light intensity controller 56 desirably includes a light intensity scale 140 that indicates the intensity of the light. In one embodiment, the light intensity scale 140 includes a series of 10 LEDs 142A-142J that indicate different light intensity levels.

In one embodiment, the light intensity controller 56 preferably includes a depressible button 144 that may be depressed for changing the light intensity and/or the direction of the light. Referring to FIG. 1, the light intensity controller 56 includes a flexible connecting wire 146 having a quick-connect connector 148 provided at the distal end thereof. In one embodiment, the connector 148 is inserted into the connector 135 on the light fixture 52 for electrically interconnecting the light intensity controller 56 with the LED driver 102 disposed inside the light engine slug 86 (FIG. 2). In one embodiment, the electrical interconnection between the light intensity controller 56 and the LED driver 102 (FIG. 2) may be achieved using various communication protocols including a wireless interface, a signal over power line connection, or an infrared style connection.

Referring to FIGS. 1 and 11, in one embodiment, the light intensity controller 56 enables a landscape lighting technician to raise or lower the light intensity level of the LED by simply holding down the depressible button 144 located on top of the light intensity controller. Initially, the light level setting cycles from low to high while the button 144 is depressed. The series of LEDs 142A-142J on the scale 140 start from a lower end to a higher end, e.g. from 1 to 10. The scale 140 allows a landscape lighting designer to set the light level by simply releasing the button 144 once a desired light level is achieved. In one embodiment, once the light level has been set, the LED driver remembers the set light level for the life of the light fixture. The setting for light intensity may be modified at any time during the life of the lighting system. After a desired light intensity level has been achieved, the light intensity controller 56 is preferably disconnected from the light fixture and the LED driver remembers the set light level. The process may be repeated on other light fixtures by connecting the light intensity controller 56 with the other light fixtures.

Although the present invention is not limited by any particular theory of operation, it is believed that the push button 144 and the light scale 140 on the light intensity controller 56 enable landscape lighting technicians to set the light level during day light, which does not require the landscape lighting technician to wait until the evening when it is dark and difficult to attach the light intensity controller to a light fixture without tripping over plants and/or possibly damaging property. The LED read out 142A-142J on the scale 140 eliminates these design and installation problems.

In one embodiment, the light intensity controller 56 reverses the direction of the light intensity each time the button 144 is pressed and released. This feature enables a landscape lighting technician to fine tune the light intensity level without cycling back completely from the lower end of the light intensity scale toward the upper end of the light intensity range. In one embodiment, a landscape lighting technician presses and holds down the button 144 as the light intensity level goes from a lower intensity level to a higher intensity level. When the light technician observes that the light is at a desired light intensity level, the light technician preferably releases the button 144 for establishing the light intensity level. However, upon further observation, the light technician may determine that the light intensity level is too high or too low and desire to further adjust the light intensity level. When the light technician releases and depresses the button 144 again, the change in the light intensity switches direction. Thus, if the light level were increasing and it was a bit too bright, a technician may release the button and then press the button again so that the direction of the change of the light intensity reverses and the light starts to dim or become less intense. This feature enables a light technician to fine tune and narrow in on the exact light level that is desired. This feature also saves a significant amount of time for the light technician since conventional methods of adjusting light intensity levels require cycling from low to high and back down to low, which is a time consuming methodology for setting a light level and is difficult for the human eye to adjust. The fine tuning feature present via the light intensity controller 56 disclosed herein enables a light technician to narrow down the light level setting to reach a desired brightness level required for a particular landscape lighting site.

Figure 12:
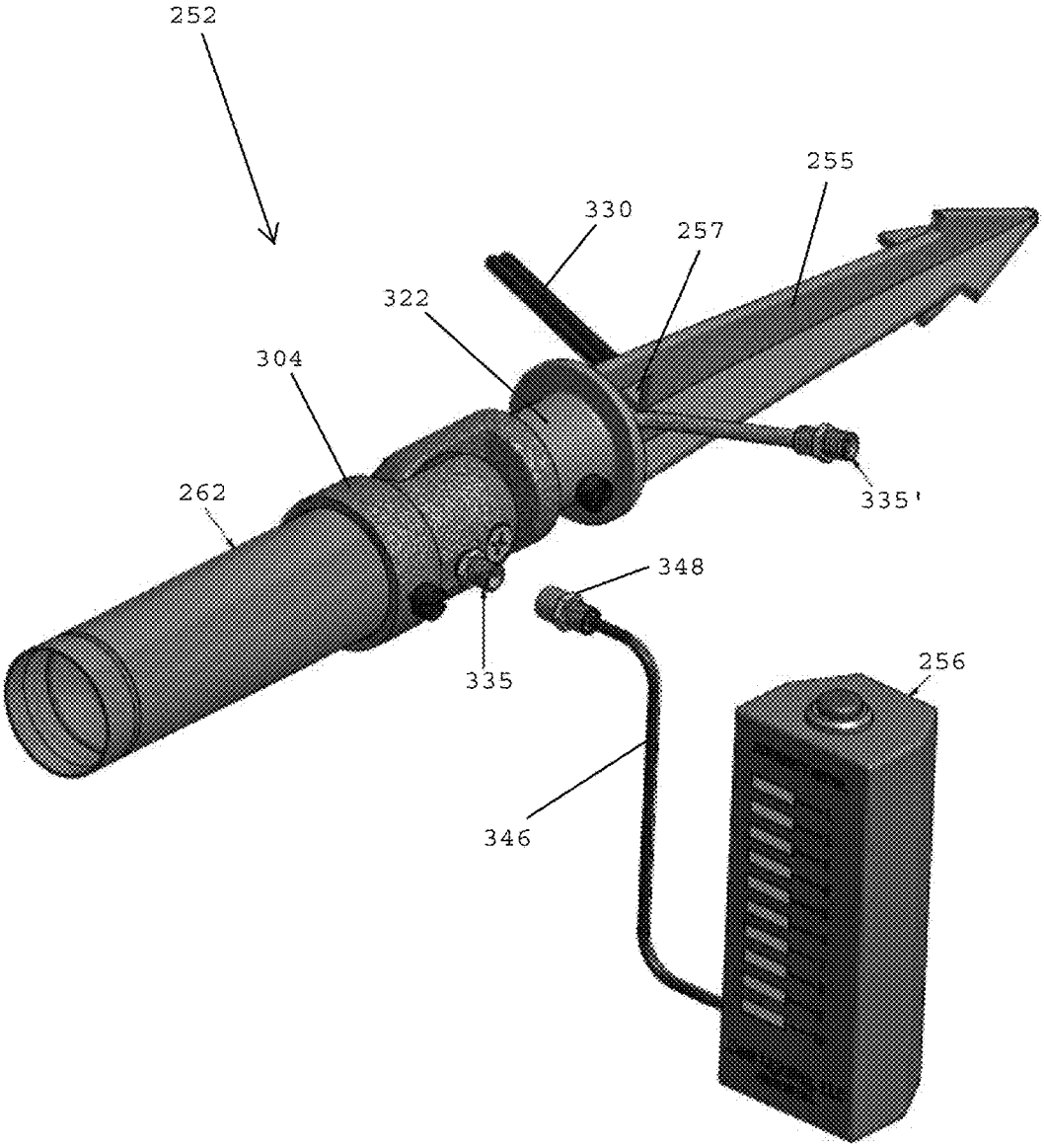
FIG. 12 shows a landscape lighting system including a light fixture and a light intensity controller, in accordance with another embodiment of the present invention.

Referring to FIG. 12, in one embodiment, a light fixture 252 is substantially similar to that shown and described herein, however, the light fixture 252 desirably includes a ground mounting stake 255 projecting from a lower end of a base 322. The light fixture 252 includes an upper knuckle 304 having a connector 335' adapted to mate with a connector 348 provided at the free end of a flexible light intensity controller cord 346 coupled with a light intensity controller 256. Once the connector 348 of the light intensity controller 256 is connected with the connector 335 on the upper knuckle 304, the light intensity controller 352 may be utilized for selecting the intensity of the light generated by an LED.

In one embodiment, a connector 335' for controlling the light intensity may extend from a lower end of the base 322. The connector 335' may be coupled with the light intensity connector 348 of the light intensity controller 256 for modifying the intensity of the light generated by the LED. In one embodiment, a power cord 330 for providing power to the light fixture 252 may pass from a bottom of the base 322 and through an opening 257 formed at an upper end of the stake 255.

Figure 13:
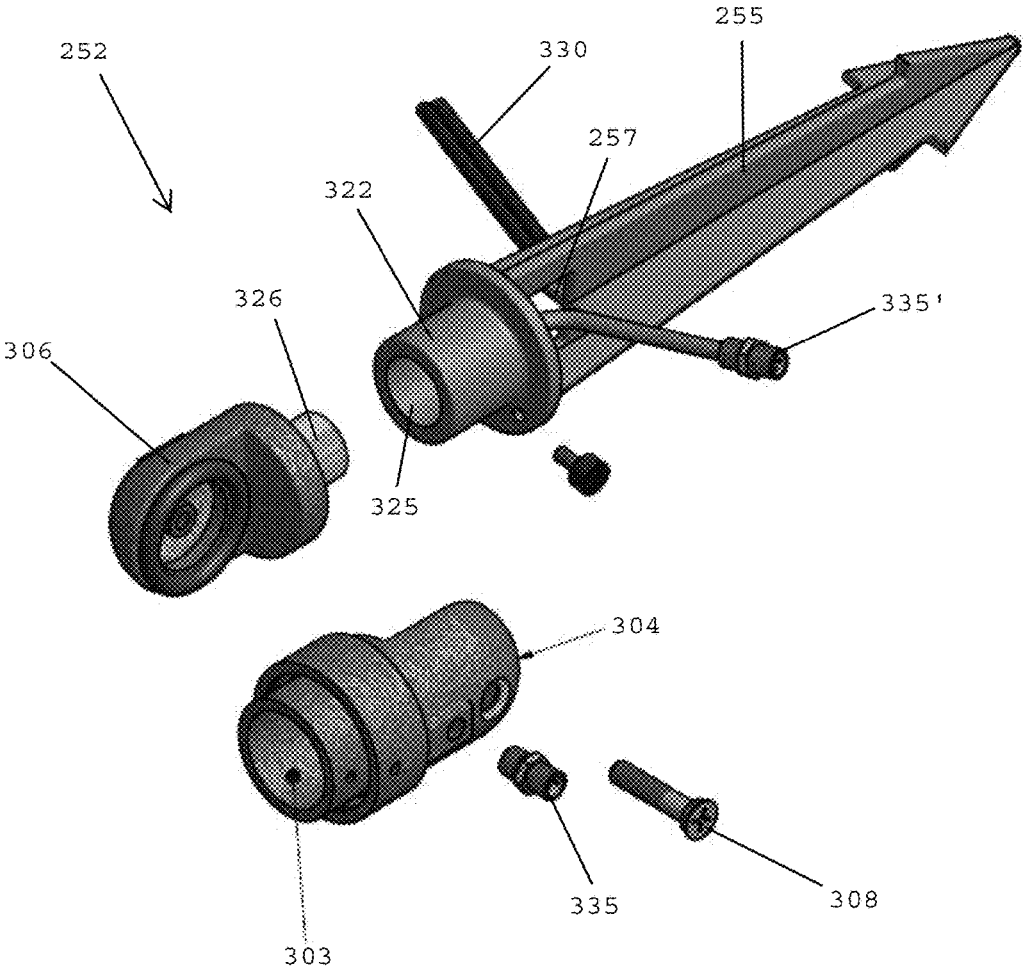
FIG. 13 shows an exploded view of an upper knuckle, a lower knuckle, and a ground-mounting stake of the light fixture shown in FIG. 12.

Referring to FIG. 13, in one embodiment, the light fixture 252 shown in FIG. 12 preferably includes an upper knuckle 304 and a lower knuckle 306 that is securable to the upper knuckle using the threaded screw 308. The connector 335 is insertable into an opening formed in the upper knuckle 304. The lower knuckle 306 includes a shaft 326, such as a cylindrical shaft, insertable into an opening 325 provided at an upper end of the base 322. The power cord 330 passes through the opening 257 in the stake 255 and into the base 322 for providing power to the light fixture 252. The auxiliary connector 335' may follow a similar path as the power cord 330 for enabling a light intensity controller to be coupled with the LED driver 302 for controlling the intensity of the light generated by an LED.

Figure 14:
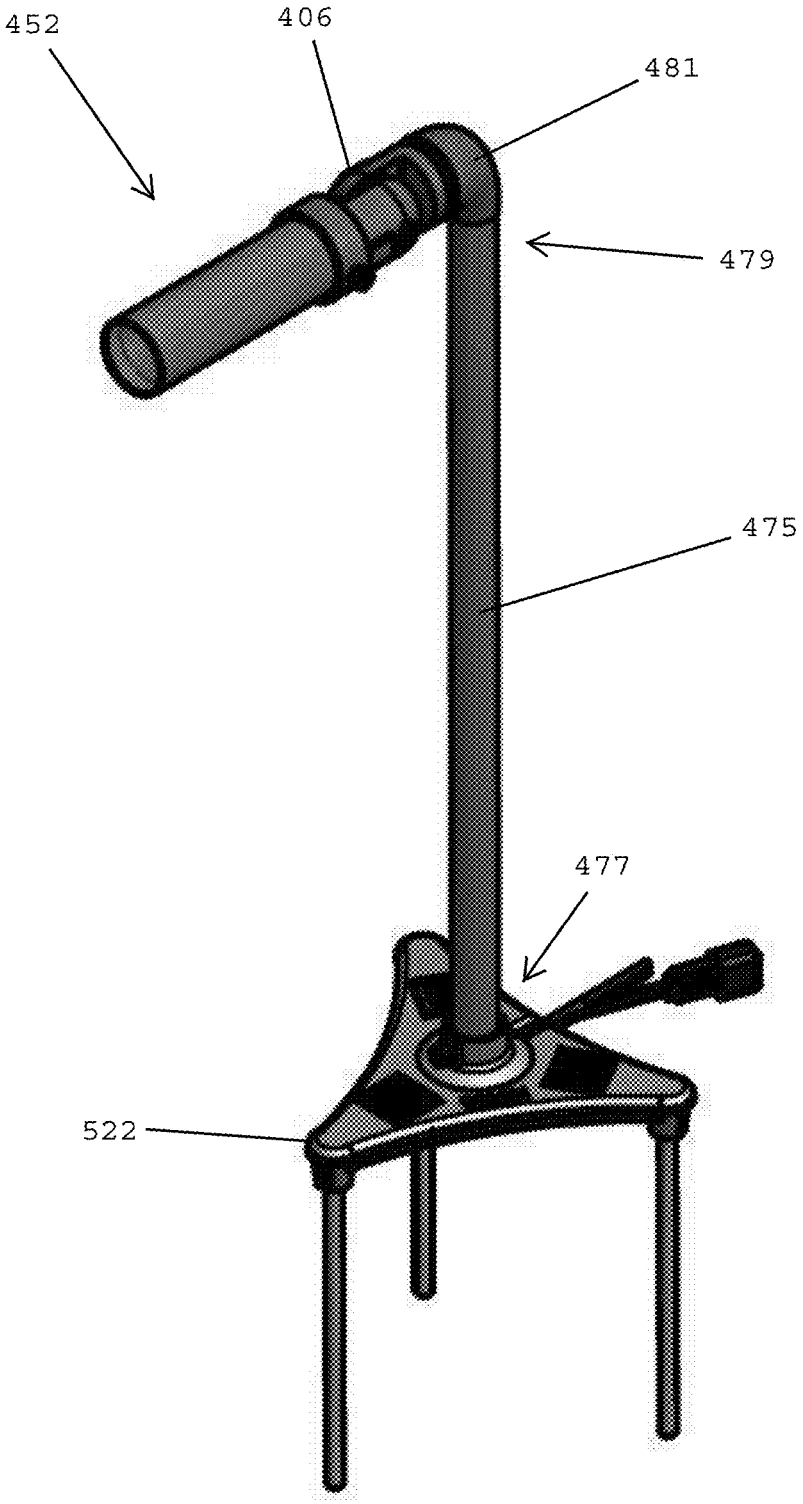
FIG. 14 shows a perspective view of a landscape lighting fixture, in accordance with another embodiment of the present invention.

Referring to FIG. 14, in one embodiment, a light fixture 452 has one or more features that are generally similar to the light fixture shown and described herein. The light fixture 452 preferably includes an extension tube 475 having a lower end 477 securable to a base 522 and an upper end 479 with an elbow 481 adapted to receive a tubular shaft of a lower knuckle 406 as shown and described herein. In one embodiment, the lower end 477 of the extension tube 475 is rotatable 360 degrees relative to the base 522. The lower knuckle 406 is rotatable 360 degrees relative to an opening provided in the elbow 481. The lower end 477 of the extension tube 475 is preferably rotatable 360 degrees relative to the base 522. When selected angles of rotation are attained, thumb screws or screw fasteners may be tightened for locking the components in desired positions.

Figure 15:
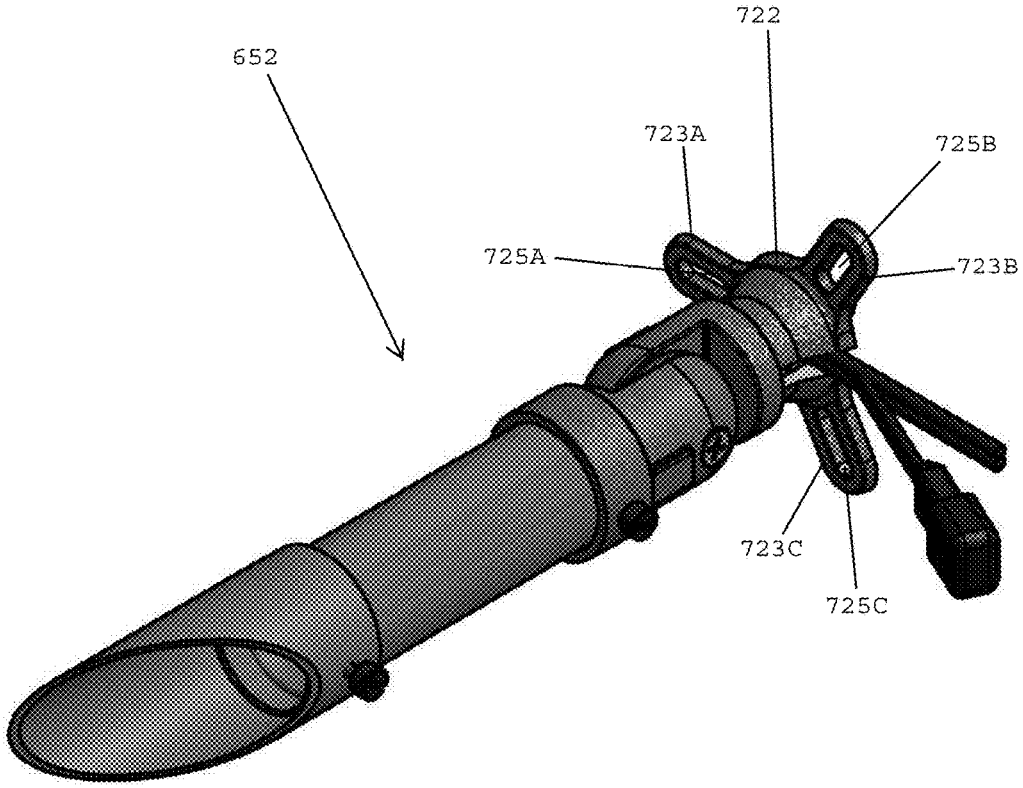
FIG. 15 shows a perspective view of a landscape lighting fixture having a mounting base, in accordance with yet another embodiment of the present invention.

Referring to FIG. 15, in one embodiment, a light fixture 652 has one or more of the structural features described herein. The light fixture 652 preferably includes a base 722 having three arms 723A-723C that are utilized for mounting the base 722 onto a surface. In one embodiment, each of the arms 723A-723C includes an opening, such as respective elongated slots 725A-725C, that enable securing elements such threaded screws to be passed therethrough. In one embodiment, the arms 723A-723C are abutted against a surface, such as a wall, floor, beam or tree surface and fasteners are passed through the elongated slots 725A-725C for mounting the base 722 to the opposing object.

Figure 16:
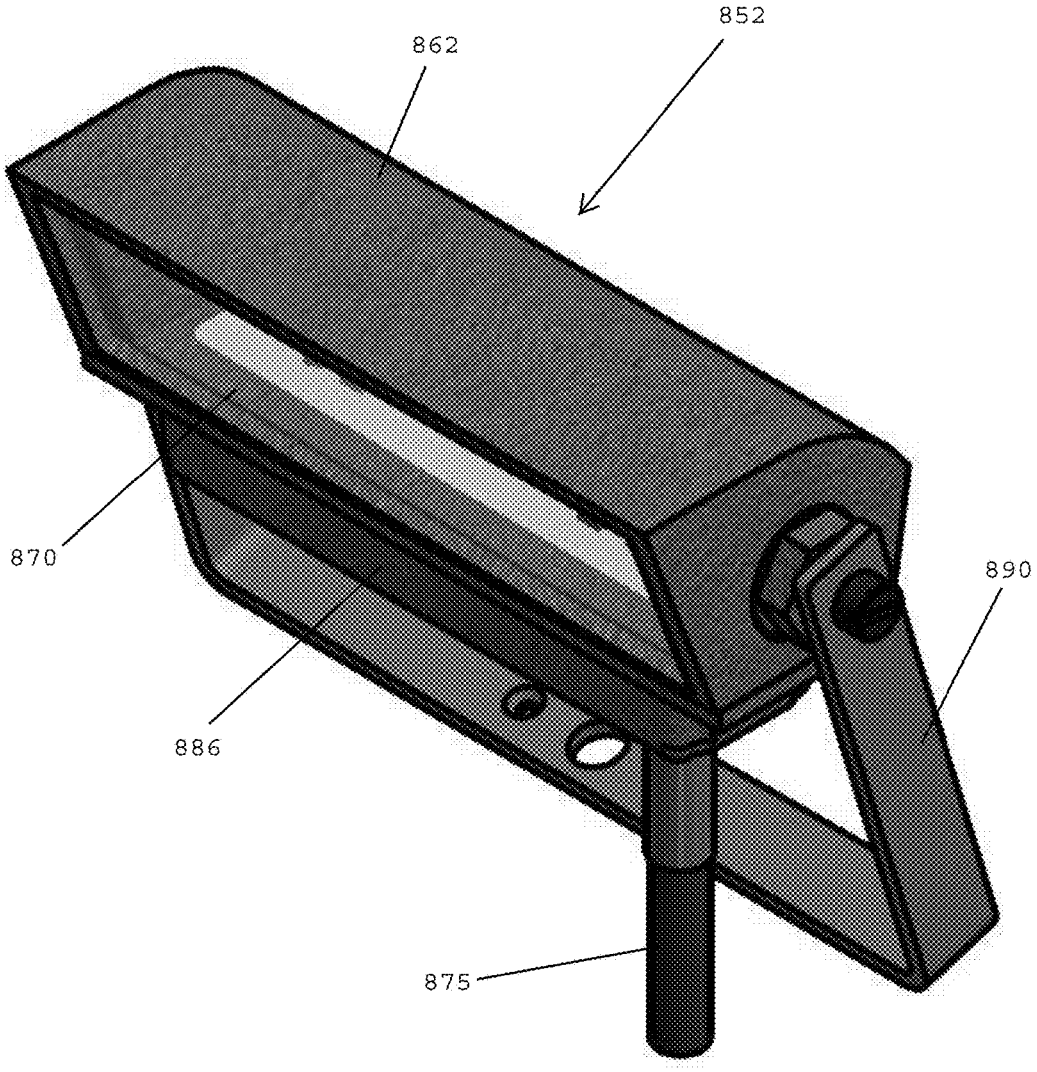
FIG. 16 shows a light fixture having mounting hardware, in accordance with another embodiment of the present invention.

Referring to FIG. 16, in one embodiment, a light fixture 852 propagates LED light having a rectangular pattern. The light fixture 852 desirably includes a pan 886 having an LED driver disposed therein. The light fixture preferably includes a body 862 having an optical lens 870 covering a front opening and one or more LEDs disposed within the body 862. The light fixture 852 includes one or more power cords and one or more controller wires disposed within a conduit 875. The power cords provide power to the LED driver disposed within the pan 886 and the controller wires control operation of the LED driver, which, in turn, controls the intensity of the light generated by the one or more LEDs disposed within the body 862.

The light fixture 852 desirably includes an adjustable bracket 890 that may be used for mounting the light fixture to a fixed object such as a wall or post. The light fixture 852 may have one or more LEDs. The intensity of the light generated by the light fixture 852 may be established using the light intensity controller shown and described herein.

Figure 17A:
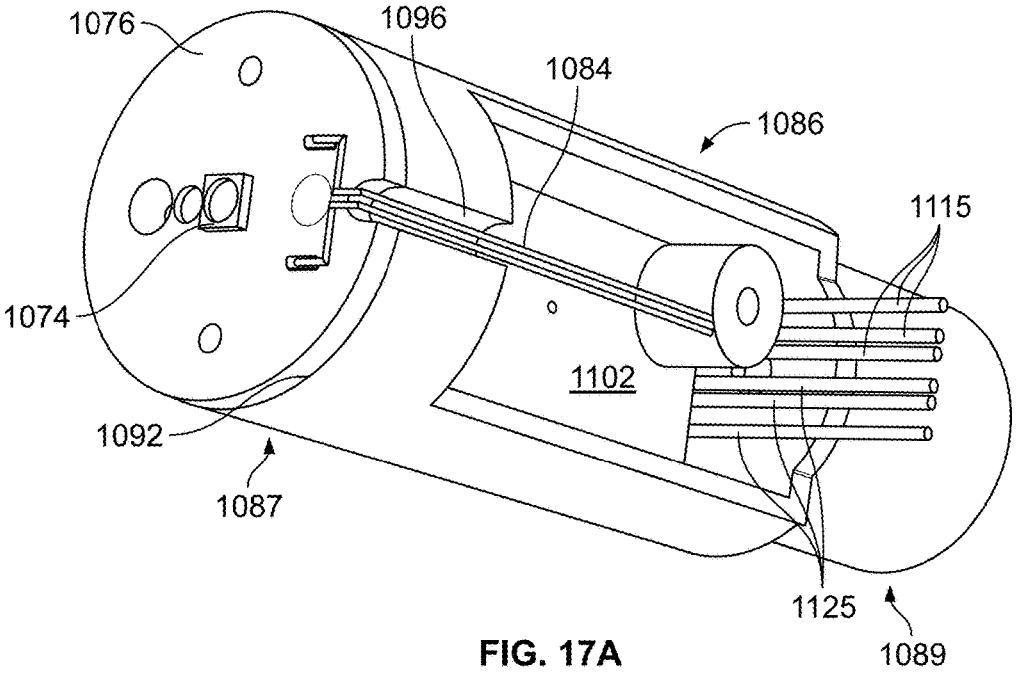
FIG. 17A shows a perspective view of a light engine slug having a leading end with an LED support base secured to the leading end and an LED driver disposed within the light engine slug, in accordance with one embodiment of the present invention.
Figure 17B:
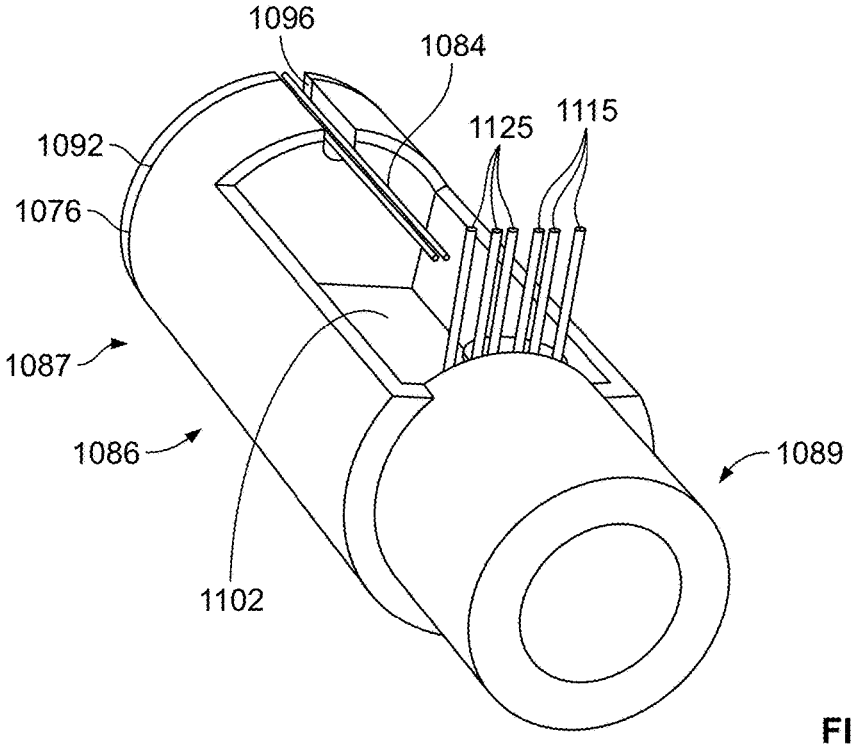
FIG. 17B shows a rear perspective view of the light engine slug, the LED base and the LED driver shown in FIG. 17A.

Referring to FIGS. 17A and 17B, in one embodiment, a light engine slug 1086 for a light fixture preferably includes a leading end 1087 having a larger diameter, and a trailing end 1089 having a smaller diameter. The smaller diameter trailing end 1089 is preferably adapted to be inserted into an opening of an upper knuckle and is shown and described herein.

In one embodiment, an LED 1074 including an LED support base 1076 is secured over the flat leading face 1092 of the light engine slug 1086. LED wires 1084 for providing power to and control of an LED extend through an elongated slot 1096 formed in the light engine slug for being electrically interconnected with the LED driver 1102 disposed inside the light engine slug. In one embodiment, the LED driver 1102 preferably includes a first set of electrical wires 1115 for providing power to the LED driver and a second set of electrical wires 1125 for controlling the intensity of the light generated by the LED 1074.

In one embodiment, the outer wall 1087 of the light engine slug 1086 preferably has one or more openings for enabling the LED wires 1084 to pass from outside the light engine slug to inside the light engine slug for being electrically interconnected with the LED driver 1102.

Figure 18:
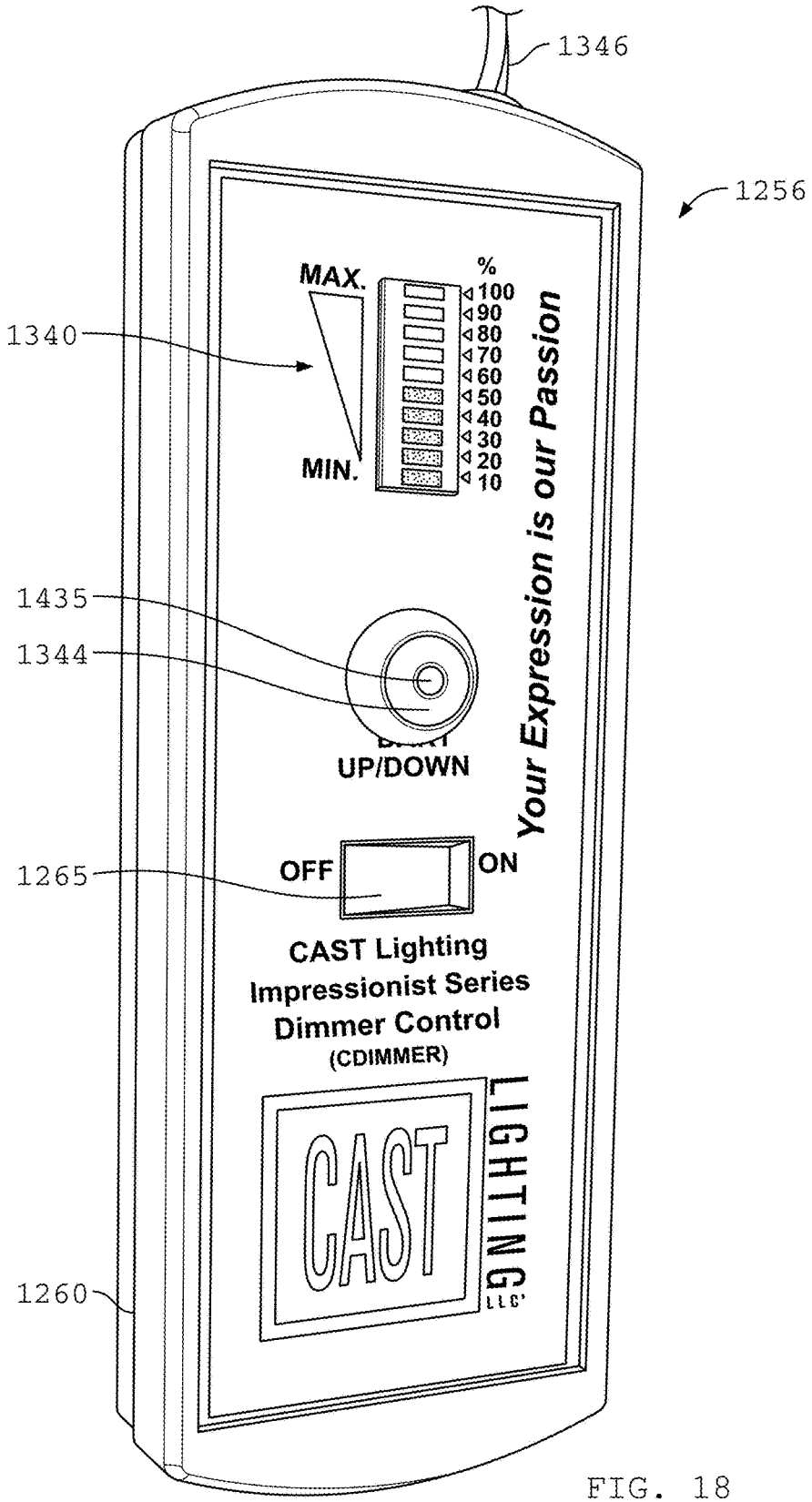
FIG. 18 shows a perspective view of a light intensity controller for a landscape lighting system, in accordance with another embodiment of the present invention.

Referring to FIG. 18, in one embodiment, a light intensity controller 1256 for a lighting system desirably includes a housing 1260 having a light fixture control circuit disposed therein. In one embodiment, the light intensity controller 1256 desirably includes an ON/OFF switch 1265 for "powering up" the light intensity controller. Although not shown, the light intensity controller 1256 desirably includes one or more power sources, such as batteries, that may be inserted into the housing 1260 for providing power to the light intensity controller. When the switch 1265 is in the OFF position, no power is provided to the light intensity controller 1256. When the switch 1265 is in the ON position, the power supply provides power to the light intensity controller 1256 for operating the light intensity controller and the various components interconnected with the light intensity controller.

In one embodiment, the light intensity controller 1256 preferably includes a light intensity scale 1340 having a series of ten LED's ranging from ten percent to 100 percent for indicating a range of light intensity levels. In one embodiment, the light intensity controller 1256 has 32 different light intensity settings, however, since the light intensity scale 1340 only shows ten LED segments, each level is associated with three of the 32 segments. In one embodiment, when the ten percent LED portion of the light intensity scale 1340 is illuminated, this covers settings one through three of the 32 brightness settings. In one embodiment, if five LED segments are lit, this covers settings 14-16 of the 32 brightness settings. In one embodiment, if six LED segments are illuminated on the light intensity scale 1340, this covers segments 13-19 of the 32 brightness settings. Other preferred circuits may have fewer or more than 32 segments and still fall within the scope of the present invention.

In one embodiment, the light intensity controller 1256 preferably includes a depressible button 1344 that may be depressed for changing the light intensity and/or the direction of the change in light intensity. In one embodiment, the depressible button 1344 includes an LED light 1345 that indicates whether the light intensity controller is ON or OFF. In one embodiment, when the switch 1265 is in the ON position, the LED light 1345 on the depressible button 1344 is illuminated to indicate that power for the light intensity controller has been turned ON.

In one embodiment, the light intensity controller 1256 includes conductive leads 1346 that may be electrically interconnected with a light fixture for controlling the LED driver and/or the LED on a light fixture.

Figure 19:
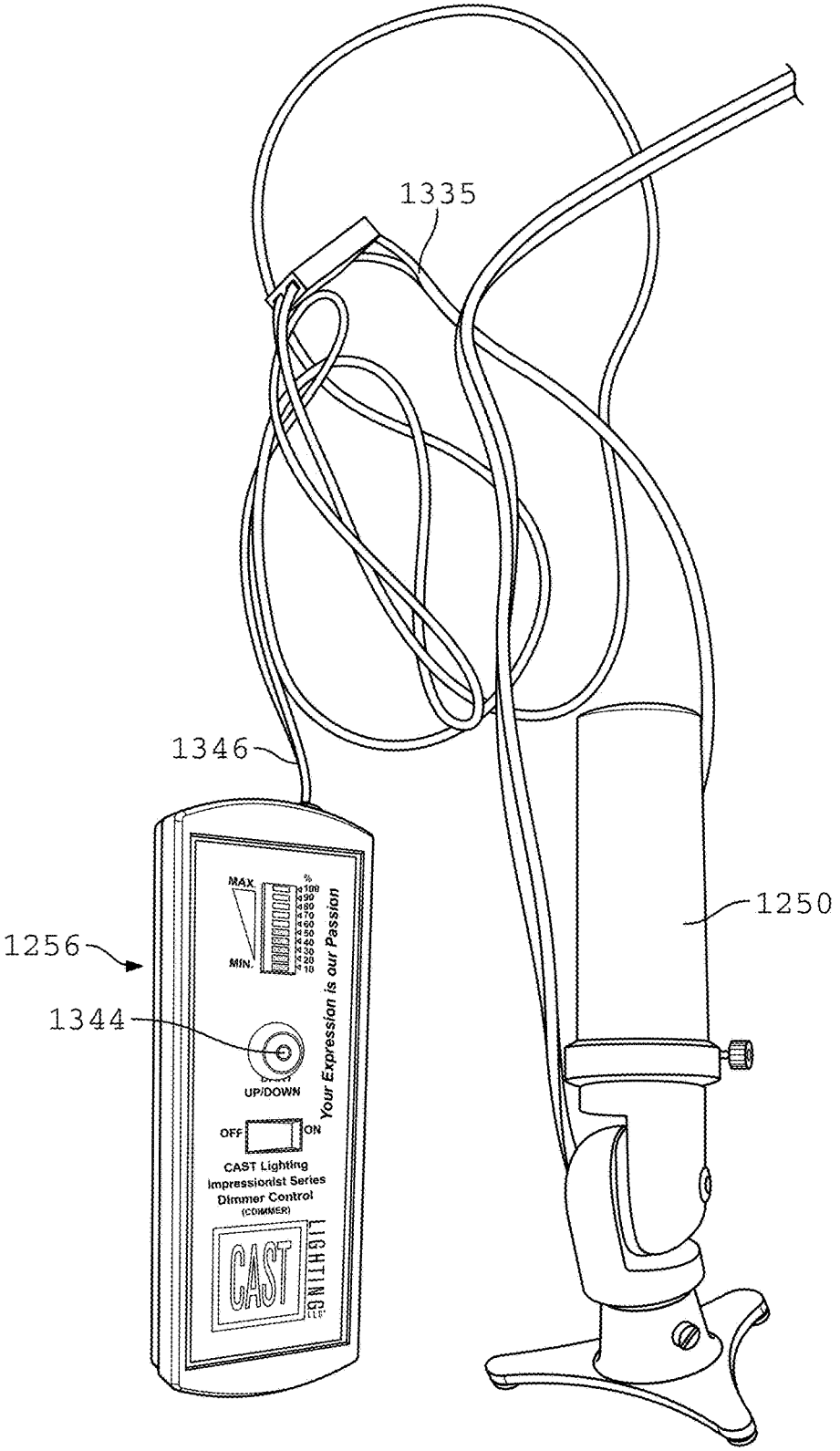
FIG. 19 shows a perspective view of a landscape lighting system including the light intensity controller of FIG. 18 connected with a light fixture, in accordance with one embodiment of the present invention.

Referring to FIG. 19, in one embodiment, the light intensity controller 1256 may be electrically interconnected with a light fixture 1250 by coupling the control leads 1346 of the light intensity controller with conductive leads 1335 extending from the light fixture 1250. In one embodiment, when the depressible button 1344 is depressed, the light fixture control circuit within the light intensity controller sends signals through the connected leads 1346, 1335 for adjusting the intensity of the light generated by the light fixture. In one embodiment, the light intensity increases the first time the button is depressed. If the depressible button 1344 remains depressed, the light intensity increases to a maximum light intensity (e.g., 100%) and then stops at the maximum light intensity level so long as the button 1344 remains depressed. If the depressible button 1344 is released and then depressed again, the change in the light intensity level reverses direction and begins to move toward the lower end of the light intensity level (i.e., the light dims). In one embodiment, if the light intensity level is dimming and the button 1344 remains depressed, the light intensity dimming will stop once it reaches the lower end of the scale of the light intensity range and will remain at the lower end so long as the button remains depressed.

Figure 20:
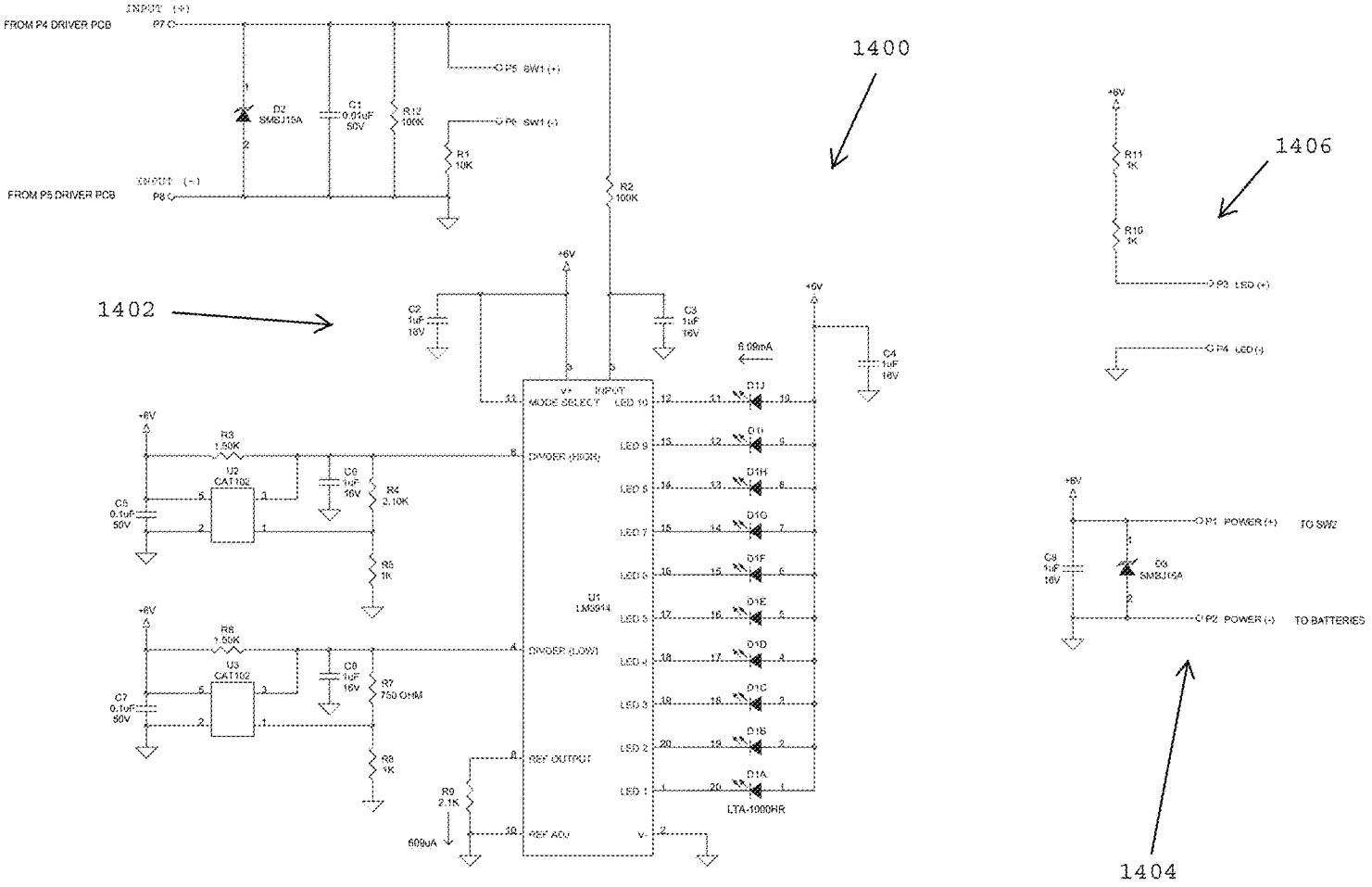
FIG. 20 is a schematic diagram of a light fixture control circuit that is incorporated into the light intensity controllers shown in FIGS. 11 and 18, in accordance with another embodiment of the present invention.

FIG. 20 shows the light fixture control circuit 1400 disposed within the light intensity controller 1256 shown in FIGS. 18 and 19. In one embodiment, the light fixture control circuit 1400 may be mounted on a circuit board such as a printed circuit board and may include a microprocessor and a memory. In one embodiment, the light fixture control circuit may be adapted for wireless communication.

The control circuit 1400 preferably includes a dimmer controller circuit 1402 that is coupled with the ON/OFF switch 1265 and the depressible button 1344 (FIG. 18); a power circuit 1404 that shows how power is provided to the light intensity controller; and an LED indicator light circuit 1406 for the LED 1345 provided on the depressible button 1344 (FIG. 18). In one embodiment, all of the circuits 1402, 1404 and 1406 are electrically interconnected and in communication with one another.

In one embodiment, the dimmer control circuit 1402 preferably has 32 brightness settings. In one embodiment, ten LED segments on the light intensity scale 1340 (FIG. 18) are proportional to the full range of the 32 brightness settings. For example, if five LED segments on the light intensity scale are lit, the dimmer control circuit 1402 is set between 14-16 of the 32 available brightness settings. If six LED light segments are lit on the light intensity scale, the 32 brightness settings are at the 17-19 range of the 32 available brightness settings.

The depressible button 1344 (FIG. 18) on the light intensity controller is in communication with the dimmer control circuit 1402. Each time the dimmer control circuit senses that the depressible button 1344 (FIG. 18) has been depressed, it switches the dimming direction. The circuit 1402 continues dimming or brightening as long as the depressible button remains depressed.

In one embodiment, the circuit 1400 uses the same two wire interface that commands the fixture to change intensity level, and to measure the dim setting (via voltage measurement). In one embodiment, the circuit measures voltage to determine the intensity setting and then illuminates the appropriate number of LED segments on the light intensity scale 1340 (FIG. 18).

In one embodiment, the light intensity scale 1340 and the LED light 1345 on the depressible button 1344 are internally powered using one or more power sources such as batteries placed within the light intensity controller. In one embodiment, if a power source such as a battery is not placed within the light intensity controller, the push button may still be depressed to allow modification of the light intensity of a light fixture. Thus, the light intensity controller may still be used to control the intensity levels of light fixtures even when the controller does not have power.

The headings used herein are for organizational purposes only and are not meant to be used to limit the scope of the description or the claims. As used throughout this application, the word "may" is used in a permissive sense (i.e., meaning having the potential to), rather than the mandatory sense (i.e., meaning must). Similarly, the words "include", "including", and "includes" mean including but not limited to. To facilitate understanding, like reference numerals have been used, where possible, to designate like elements common to the figures.

While the foregoing is directed to embodiments of the present invention, other and further embodiments of the invention may be devised without departing from the basic scope thereof, which is only limited by the scope of the claims that follow. For example, the present invention contemplates that any of the features shown in any of the embodiments described herein, or incorporated by reference herein, may be incorporated with any of the features shown in any of the other embodiments described herein, or incorporated by reference herein, and still fall within the scope of the present invention.

What is claimed is:

1. A landscape lighting system comprising:

a light fixture including an LED;

a first light diverting element having a first light diversion angle associated therewith;

a second light diverting element having a second light diversion angle associated therewith that is different than the first light diversion angle;

a light intensity controller for communicating with said light fixture to selectively control the intensity of the light generated by said LED, wherein said light intensity controller is in wireless communication with said light fixture, and wherein said light fixture comprises an anchoring element for securing said light fixture at selected locations;

wherein said light fixture comprises an articulating knuckle that enables said light fixture to be positioned at different angles.

2. The landscape lighting system as claimed in claim 1, wherein said light fixture has a first configuration in which said first light diverting element overlies said LED for emitting light having the first light diversion angle, and wherein said light fixture has a second configuration in which said second light diverting element overlies said LED for emitting light having the second light diversion angle.

3. The landscape lighting system as claimed in claim 2, wherein said first and second light diverting elements are interchangeable, and wherein only one of said first and second light diverting elements is secured over said LED at any one time.

4. The landscape lighting system as claimed in claim 1, wherein at least one of said first and second light diverting elements comprises a colored lens.

5. The landscape lighting system as claimed in claim 1, further comprising:

a plurality of light fixtures;

each said light fixture including an LED;

each said light fixture comprising a first light diverting element having the first light diversion angle associated therewith, and a second light diverting element having the second light diversion angle associated therewith that is different than the first light diversion angle.

6. The landscape lighting system as claimed in claim 5, wherein said light intensity controller is adapted to increase and decrease the intensity level of only one of said plurality of light fixtures at any one time.

7. The landscape lighting system as claimed in claim 1, wherein said light intensity controller includes a control element that enables an operator to selectively increase and decrease the intensity level of the light generated by said LED, and wherein said light intensity controller includes indicia provided thereon that indicate the intensity level of the light generated by said LED.

8. The landscape lighting system as claimed in claim 1, wherein said wireless communication comprises infrared communication.

9. The landscape lighting system as claimed in claim 1, wherein said light fixture uses low voltage.

10. The landscape lighting system as claimed in claim 1, further comprising:

a glare shield mounted on said light fixture;

a glare shield fastener for securing said glare shield to said light fixture, wherein said glare shield rotates and moves telescopically relative to said light fixture, and wherein said glare shield fastener is tightened for preventing further rotation or telescopic movement of said glare shield relative to said light fixture.

11. The landscape lighting system as claimed in claim 1, wherein one of said first and second light diverting elements has a light diversion angle of about 36 degrees, and the other one of said first and second light diverting elements has a light diversion angle of about 60 degrees.

12. A landscape lighting system comprising:

a light fixture including at least one LED and an LED driver electrically interconnected with said at least one LED for controlling operation of said at least one LED;

a plurality of light diverting elements configured for optical alignment with said at least one LED, wherein each said light diverting element has a unique light diversion angle associated therewith;

a glare shield mounted on said light fixture, wherein said glare shield rotates and moves telescopically relative to said light fixture;

a light intensity controller in communication with said LED driver, wherein said light intensity controller includes a control element that enables an operator to selectively increase and decrease the intensity of the light generated by said at least one LED, and wherein said light intensity controller is in wireless communication with said light fixture.

13. The landscape lighting system as claimed in claim 12, further comprising at least one guide pin for positioning said light diverting elements over said at least one LED.

14. The landscape lighting system as claimed in claim 12, wherein said plurality of interchangeable light diverting elements comprise a first light diverting element having a light diversion angle of about 60 degrees and a second light diverting element having a light diversion angle of about 36 degrees.

15. The landscape lighting system as claimed in claim 12, wherein said light intensity controller includes indicia provided thereon that indicate the intensity level of the light generated by said light fixture, and wherein said light intensity controller comprises at least one depressible button for adjusting the intensity level of the light generated by said light fixture.

16. The landscape lighting system as claimed in claim 12, further comprising a plurality of light fixtures, wherein said light intensity controller is adapted to wirelessly communicate with each said light fixture for selectively increasing and decreasing the intensity level of the light generated by each said light fixture, and wherein said light intensity controller is in wireless communication with only one of said light fixtures at any one time.

17. A method of controlling the light generated by a light fixture comprising:

providing a light fixture including at least one LED and an LED driver electrically interconnected with said at least one LED for controlling operation of said at least one LED;

providing a first light diverting element having a first light diversion angle associated therewith;

providing a second light diverting element having a second light diversion angle associated therewith that is different than the first light diversion angle;

providing a light intensity controller adapted to communicate with said light fixture for adjusting the intensity of light generated by said at least one LED, wherein said light intensity controller is in wireless or infrared communication with said light fixture;

providing a light fixture control circuit that uses low voltage and is configured for communicating with said light intensity controller for selectively increasing and decreasing the intensity of the light generated by said at least one LED;

wherein the providing a light fixture step includes providing an anchoring element and using said anchoring element for securing said light fixture at a selected location;

providing an articulating knuckle on said light fixture and after securing said light fixture at the selected location using said articulating knuckle for positioning said light fixture at different angles.

18. The method as claimed in claim 17, further comprising:

positioning said first light diverting element over said at least one LED so that the light generated by said at least one LED passes through said first light diverting element;

using said light intensity controller for operating said light fixture control circuit for changing the intensity of the light generated by said at least one LED;

positioning said second light diverting element over said at least one LED so that the light generated by said at least one LED passes through said second light diverting element;

providing an articulating knuckle on said light fixture and using said articulating knuckle for positioning said light fixture at different angles.

19. The method as claimed in claim 18, wherein said first and second light diverting elements are interchangeable, and wherein only one of said first and second light diverting elements are secured over said LED at any one time.

* * * * *